US005476578A

United States Patent [19]

Forand et al.

[11] Patent Number: 5,476,578

[45] Date of Patent: Dec. 19, 1995

[54] APPARATUS FOR ELECTROPLATING

[75] Inventors: James L. Forand; Harold M. Keeney, both of Whitehall; Erik S. Van Anglen, Quakertown, all of Pa.

[73] Assignee: Electroplating Technologies, Ltd., Northampton, Pa.

[21] Appl. No.: 316,530

[22] Filed: Sep. 30, 1994

Related U.S. Application Data

[63] Continuation-in-part of Ser. No. 179,520, Jan. 10, 1994.

[51] Int. Cl.[6] ..... C25D 7/06

[52] U.S. Cl. ..... 204/207; 204/289

[58] Field of Search ..... 204/207, 208, 204/209, 206, 289; 205/130, 129, 93

[56] References Cited

U.S. PATENT DOCUMENTS 4,235,691 11/1980 Loqvist ..... 204/212

4,946,571 8/1990 Simon ..... 204/206

*Primary Examiner*—John Niebling

*Assistant Examiner*—Brendan Mee

*Attorney, Agent, or Firm*—Charles A. Wilkinson

[57] ABSTRACT

A continuous strip is electrolytically coated in an electrolytic coating bath using a thin flexible or resilient dielectric wiping blade to wipe bubbles of hydrogen from the surface, sever dendritic material, if such is present as the coating thickens, and to remove a surface layer of partially depleted electrolytic solution, replacing with fresh solution and to stabilize strip portions extending between support rolls. The resilient dielectric wiper blade is preferably used with perforated anodes which allow fresh electrolytic solution to flow into the space between the anodes and the strip surface after being expelled by passage of the strip past the wiping blade. The orifices in the anode may be differentially sized to eliminate cavitation behind the wiping blades. The wiping blades may be chevron shaped to increase the wiping effect and pumps may be used to increase the flow of electrolytic solution into and out of the space between the anodes and the strip. Chevron shaped wiping blades may be used to increase the wiping effectiveness and continuous movable wiping blades may be used to provides additional wiping surface as the original wiping surface wears down. The wiping blades may also be angularly oriented with respect to the strip to increase the wiping effectiveness.

29 Claims, 14 Drawing Sheets

Fig. 21
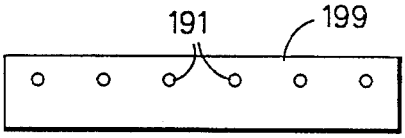
Fig. 22
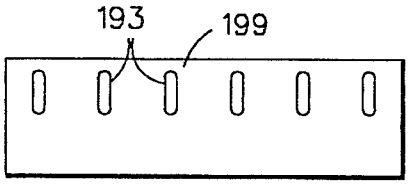
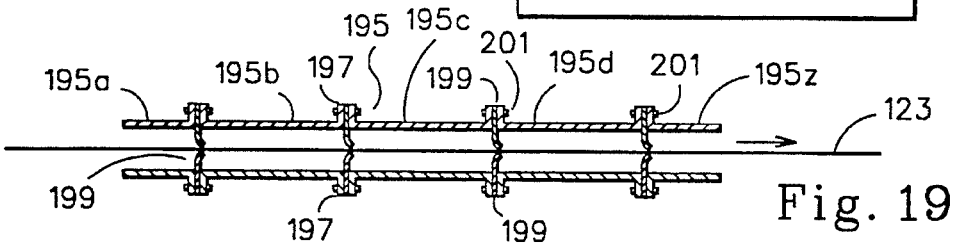
Fig. 19
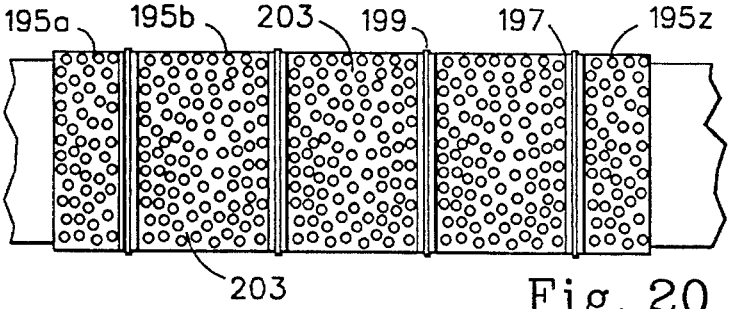
Fig. 20
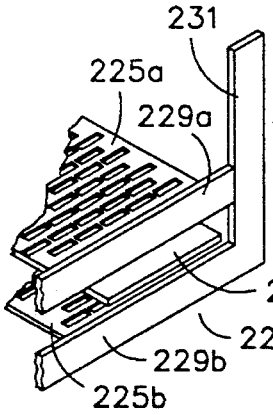
Fig. 24
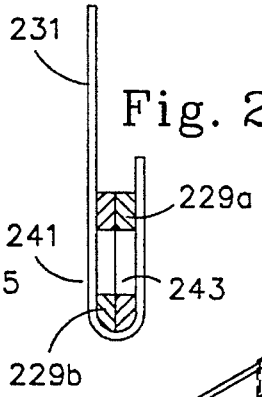
Fig. 27
Fig. 23
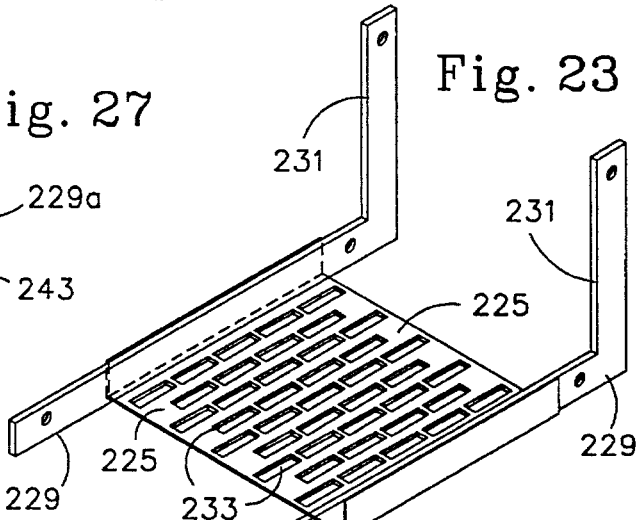
Fig. 25
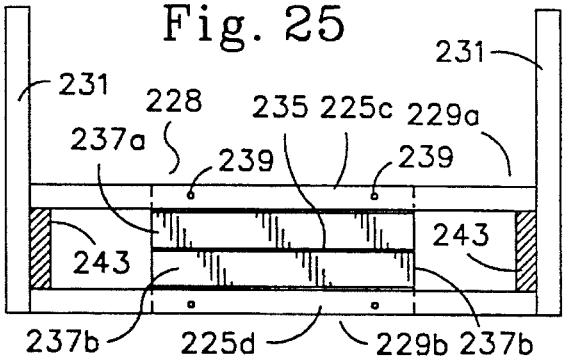
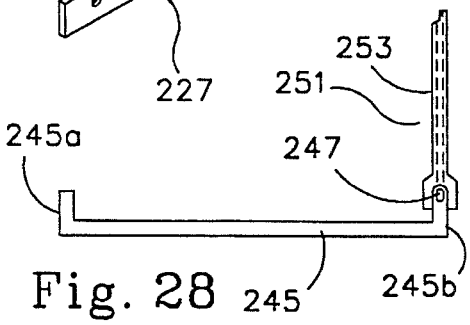
Fig. 28

Fig. 26
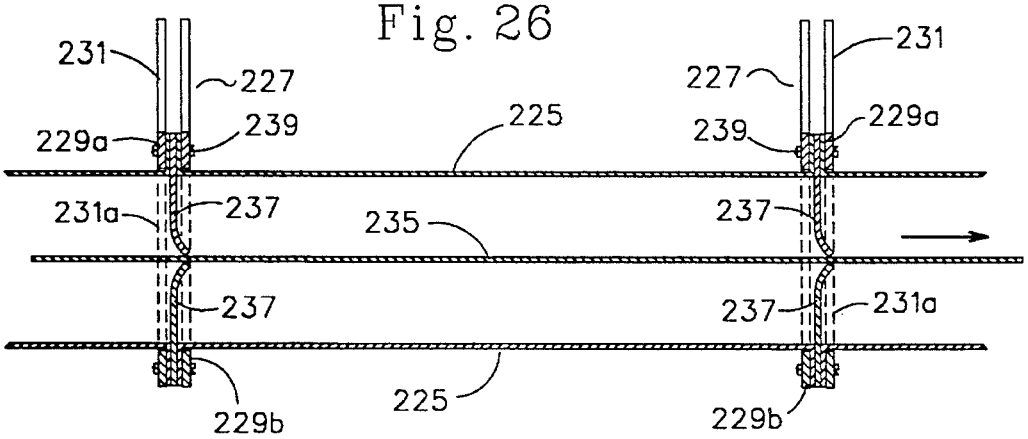
Fig. 30
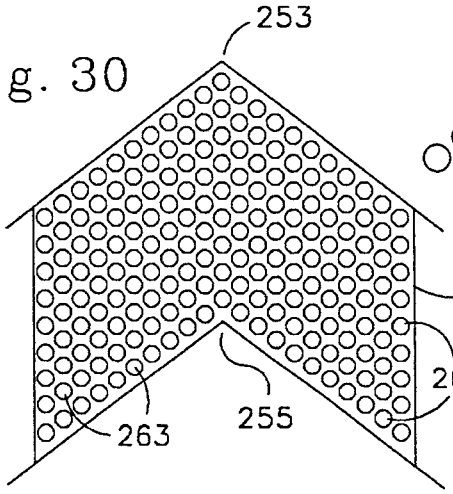
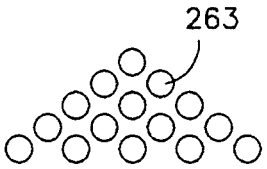
Fig. 30A
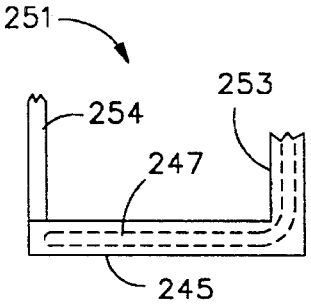
Fig. 28A
Fig. 29
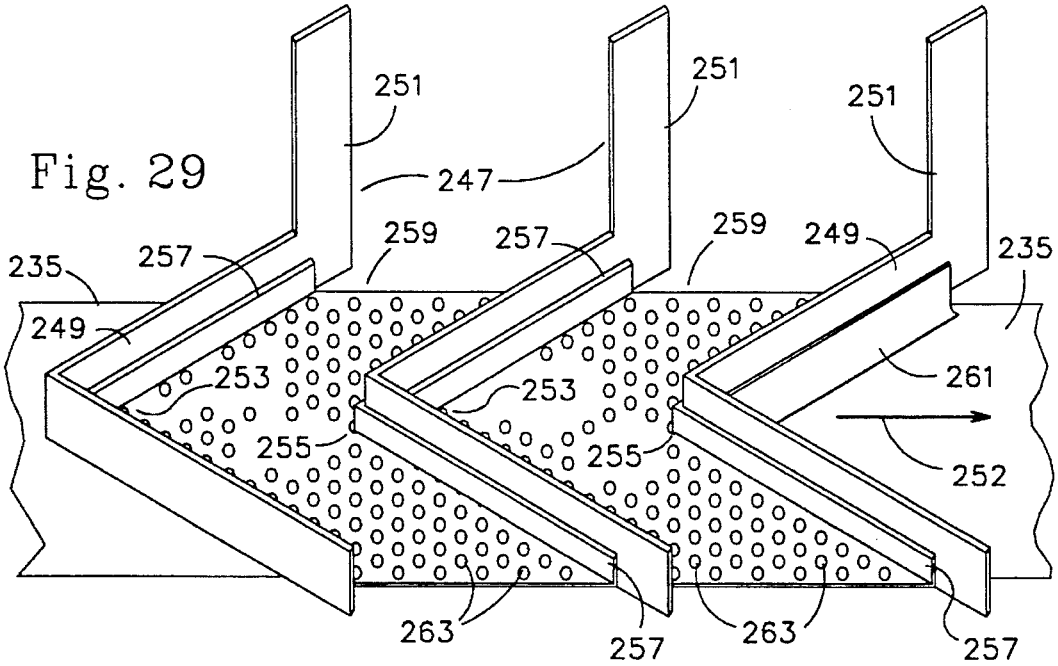

Fig. 31
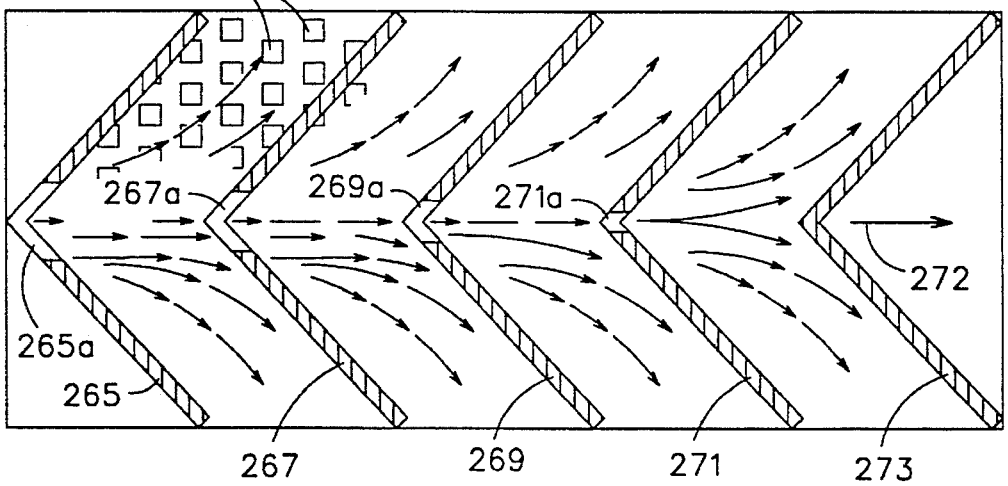
Fig.31A
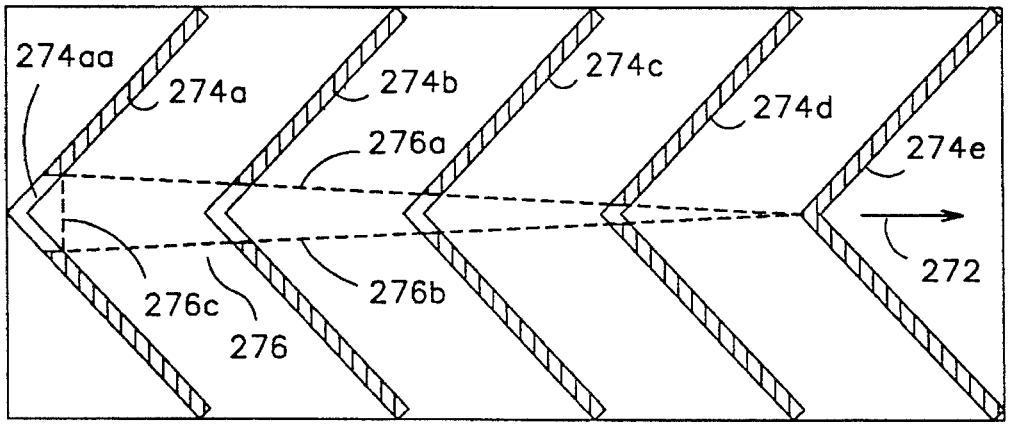
Fig. 32
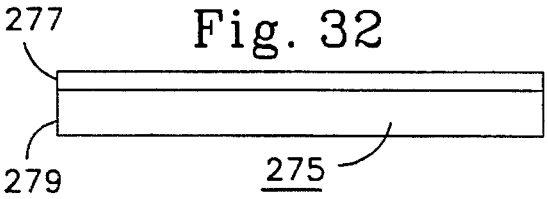
Fig. 34
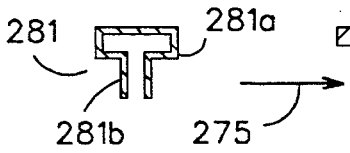
Fig. 33
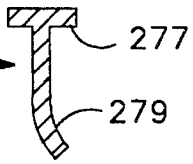
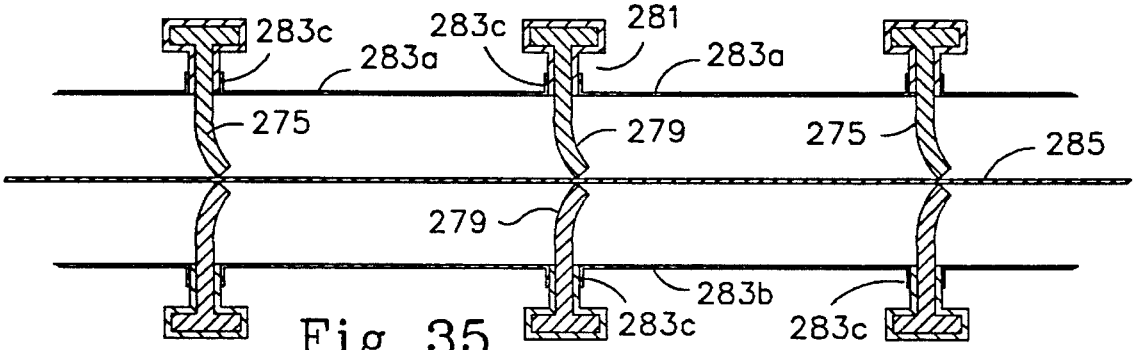
Fig. 35

Fig. 42
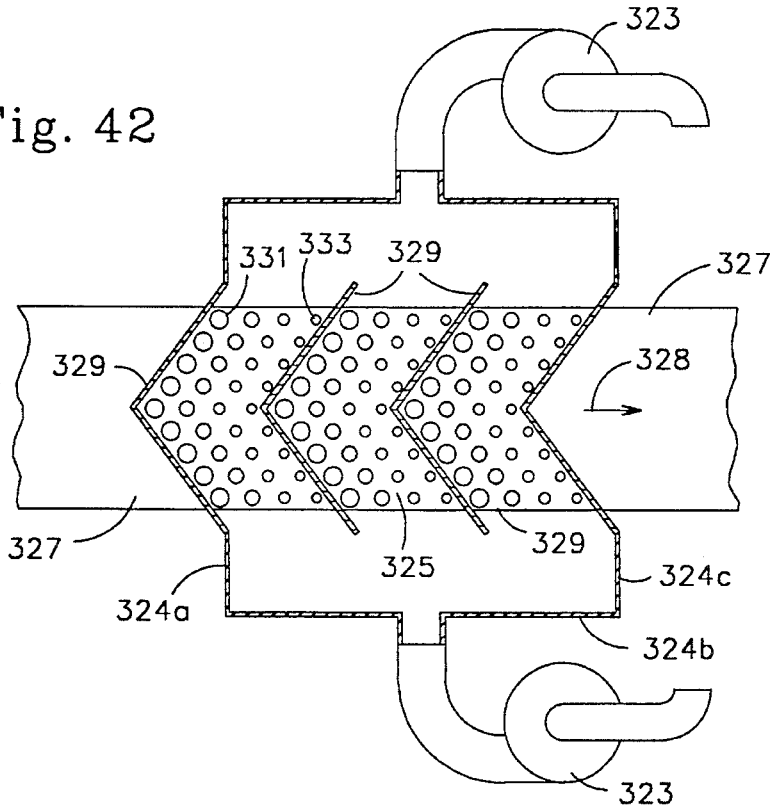
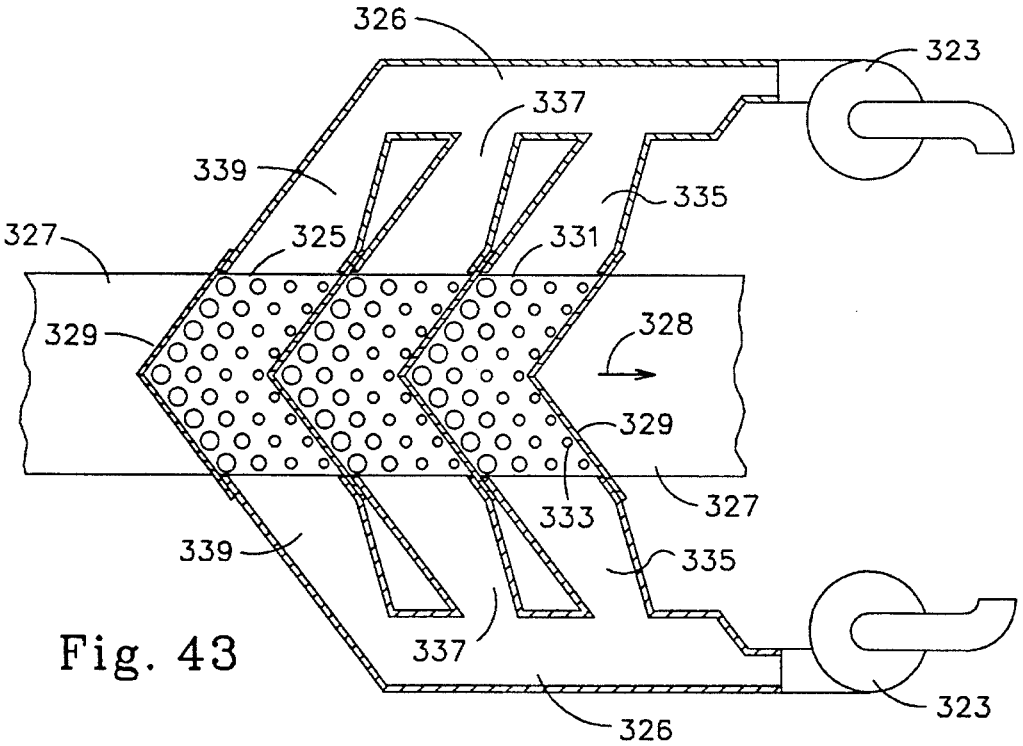
Fig. 43

Fig. 44
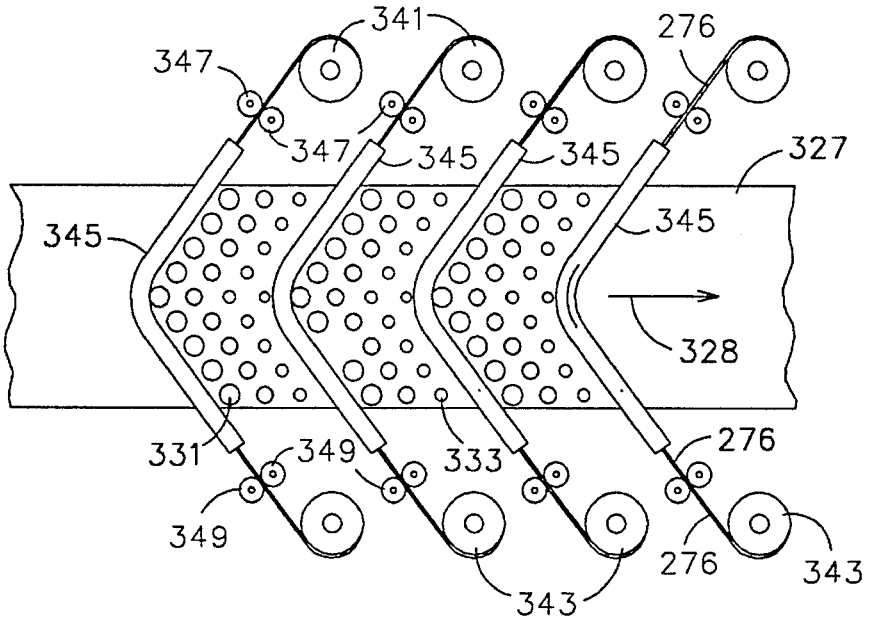
Fig. 46
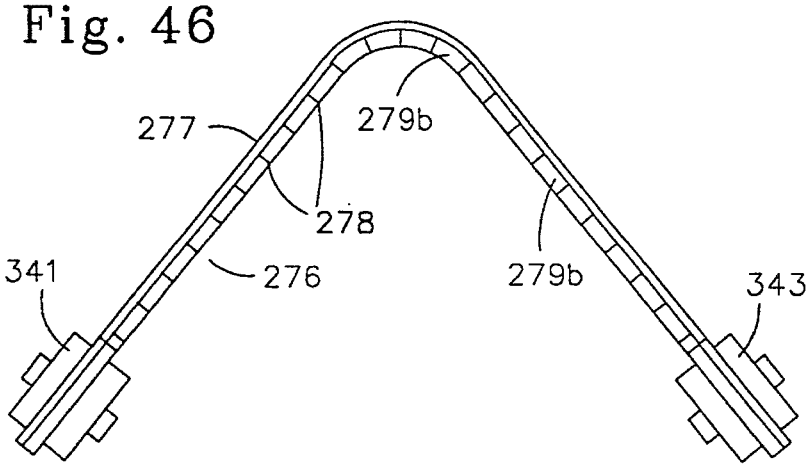
Fig. 47
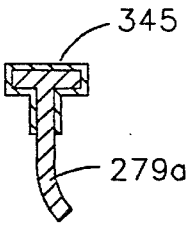
Fig. 45
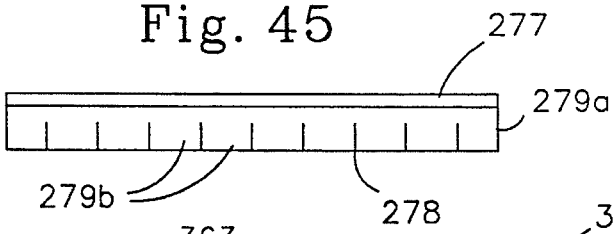
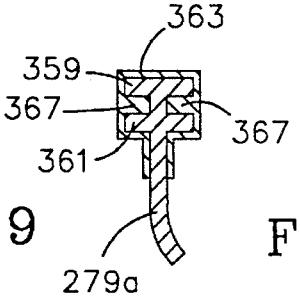
Fig. 49
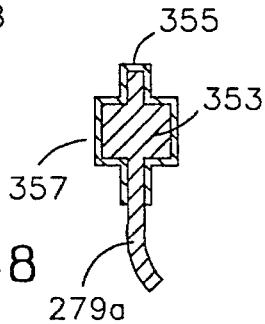
Fig. 48

APPARATUS FOR ELECTROPLATING

RELATED APPLICATIONS

This application is a continuation-in-part of U.S. application Ser. No. 08/179,520 filed Jan. 10, 1994.

BACKGROUND OF THE INVENTION (1) Field of the Invention

This invention relates to the deposition of metallic coatings from plating solutions. More particularly, this invention relates to wiping the cathodic coating surface of sheet and strip and during continuous electroplating and more particularly still to the use of a substantially solid wiper blade during such electroplating.

(2) Prior Art

As detailed more particularly in U.S. application Ser. No. 08/179,520 filed Jan. 10, 1994, the disclosure of which is hereby expressly incorporated in and made a part of the present application, a number of coatings are deposited from so-called plating baths subjected to an imposed electrical potential basically enhancing an already naturally occurring tendency for metal ions in the solution to plate out.

Since the coating of a cathodic workpiece is largely merely the acceleration of a naturally occurring process or phenomena, fairly small changes in technique and apparatus accentuating those conditions that favor deposition and de-emphasizing these conditions that disfavor deposition, may have rather large effects upon the final coating obtained. The history of improvements in the field, therefore, is largely one of progressive small improvements and adjustments to improve the conditions for deposition of various coating metals on a metallic substrate temporarily included as the cathode in a plating circuit.

It has been found, for example, by the present inventors as well as others that it is conducive to good coating results to remove the hydrogen bubbles which are produced at the cathodic work surface by transfer of electrons not only to the positive ions of the coating metal in the solution, but also to positive hydrogen ions in the electrolytic solution. The initial cathodic film is believed to be a combination or mixture of both hydrogen ions and atomic or molecular hydrogen. This film initially is only one atom thick. It interferes to some extent with good coating in that it may tend to hold the larger metallic coating ions away from the surface to be coated. However, the hydrogen atoms are small and the layer of hydrogen is initially discontinuous so that their initial interference with coating is not too serious.

If nothing is done to remove the hydrogen from the surface coating during the coating process, coating will usually continue, even though it may be seriously interfered with by the increasing hydrogen present as the thickness of the hydrogen layer increases the interference with efficient plating out of metal atoms upon the substrate surface. Such hydrogen, as it accumulates, however, tends to coalesce into larger local accumulations resulting in small bubbles and then larger and larger bubbles until such bubbles have sufficient volume and buoyancy to overcome their initial attraction for or adhesion to the substrate surface and float upwardly in the solution to the surface where they are finally dissipated into the surrounding atmosphere or local environment. Consequently, the hindrance to coating caused by the presence of hydrogen gas at the surface of a cathodic workpiece does not tend to progress to the limit where it would cut off electrolytic plating completely. However, hydrogen is still a very significant hindrance to rapid coating or plating and the larger bubbles clinging to the surface of a workpiece may even lead to macroscopic pits and other defects in an electrolytic coating.

A second significant problem which has been long recognized in electrolytic coating baths is depletion of the electrolytic solution as coating progresses. In many cases, the only result is that the coating rate slows down as there are progressively less coating metal ions in the solution to plate out. This decreasing coating rate has been counteracted by pumping in fresh coating solution, throwing in chunks of soluble coating metal for solution to "beef up" the electrolyte as well as other expedients. The trend has been for closer and closer control of the electrolyte composition during coating. Sometimes this has been implemented by continuous testing or analysis of the electrolytic bath as coating progresses. In addition, the coating solution baths have been mixed by impellers or the like, force circulated and re-circulated as well as frequently tested to hold them to a desired composition.

It has also been recognized that the coating bath next to a workpiece being coated may become locally depleted of coating metal ions and that such depletion may compromise efficient coating. Some installations have adopted the expedient of forced circulation of electrolyte past the point of coating or through a restricted coating area to increase the efficiency of coating. If the forced circulation is rapid enough, such circulation in itself also tends to detach bubbles of hydrogen from the cathodic coating surface, in effect, "killing two birds with one stone". However, the use of forced circulation of this type by pumps, jets and the like is not only unwieldy and expensive, but is believed by some to possibly have detrimental effects upon the coating itself because of the generalized rapidity of movement between the coating solution and cathodic workpiece, which macroscopically, at least, may interfere with efficient plating out of the metallic ions upon such work surface. Among the processes which have made use of rapid forced circulation is the so-called gap coating process in which a small coating gap between a coating anode and a cathodic workpiece is created and electrolytic solution is forced rapidly through such gap or opening.

Depletion of the coating solution has recently been found by one of the present inventors to be particularly serious in chrome plating solutions in which insoluble electrodes are used. It has been found that unless the chromium plating operation is maintained substantially continuous and at a fairly uniform rate that hard chrome is difficult to efficiently plate out in a brush-type coating operation, or, for that matter, in semi-brush type operations.

While various efforts to remove hydrogen bubbles from the coating surface in an electrolytic coating bath at the point of deposition have been tried, none has provided the ultimate quality of coating and efficiency of the coating operation which has been desired. Likewise, the ultimate in practical prevention of localized depletion in a coating bath has also not been attained.

A further problem in the continuous coating of a flexible material such as sheet, strip and wire products is that the efficiency of electroplating usually increases as the spacing between the electrodes, one of which is the material to be coated, decreases. In other words, the efficiency of coating is usually inversely related to the spacing between the electrodes one of which is the workpiece. However, due to the flexibility of the material being coated, it must, as a practical matter, be held away from the opposing electrode a sufficient distance to prevent arcing between the cathodic work material and the coating electrodes or anodes. The longer the unsupported run of material past the coating electrodes, the more deviation of the flexible material from its intended path is likely to occur, while closer spacing of supporting rolls or the like decreases the area available for coating and interferes with continuous coating. Very close spacing of the coating electrodes and the material being coated has been effected by the so-called jet coating process alluded to previously, but such process is complicated and sensitive to minor changes, making it suitable only for highly sophisticated coating lines.

There has been a need, therefore, for a means for removing hydrogen bubbles and cathodic film from a cathodic coating surface, preventing localized depletion of the coating bath with respect to coating material as well as allowing closer spacing of the coating electrodes and material being coated. The present applicants have found that a very effective means for accomplishing all three of these purposes is by the use of a relatively thin wiping blade applied to the surface of the workpiece at spaced intervals with a light contact. Such wiping blade deviates or strips away from the coating surface the relatively stable surface layer of electrolyte which tends to be drawn along with a moving cathodic surface, mixing and encourages replenishing of the electrolyte next to the cathodic surface. It also at the same time wipes or sweeps away bubbles of hydrogen as well as encourages coalescence of small bubbles and films of hydrogen into large bubbles for subsequent wiping away. In addition, the wiping blade very effectively supports the material being coated, particularly in the case of relatively flexible material, and prevents its deviation from its intended path and, therefore, allows closer spacing of the coating electrodes and the surface of the material being coated. Some of the more pertinent prior art patents related to the above noted problems and their solution are as follows.

U.S. Pat. No. 442,428 issued Dec. 9, 1890 to F. E. Elmore, discloses burnishing of the surface of a product being electroplated by impinging a burnishing material such as agate, bloodstone, flint or glass against the surface being coated during the time coating deposition is proceeding. These substances are characterized by Elmore as being non-conducting substances capable of burnishing and not acted upon by the coating electrolyte.

U.S. Pat. No. 817,419 issued Apr. 10, 1906 to O. Dieffenbach, discloses the use of comminuted kieselguhr in an electrolytic bath to act upon the surface of a workpiece during electrodeposition of metallic coatings. Dieffenbach states that his kieselguhr has an advantage over previously used sand, pumice-stone, brick dust, wood flour, and chaff of being "much harder and sharper edged so that it is capable of cutting up more readily" than the other substances, "the small bubbles of hydrogen that are deposited on the cathode".

U.S. Pat. No. 850,912 issued Apr. 23, 1907 to T. A. Edison, discloses that during the plating of iron, the formation of gas bubbles frequently results in the coating being pitted or even perforated. In order to avoid such pitting by the formation of gas bubbles, Edison introduces a quantity of crushed charcoal into the solution which, he states, "will rub over and scour the surface of the deposited metal to polish the same and wipe off any gas bubbles which may tend to accumulate thereupon".

U.S. Pat. No. 1,051,556 issued Jan. 28, 1913 to S. Consigliere, discloses the use of a number of small, non-conducting bodies such as glass or porcelain balls and pebbles having rounded edges within an electrolytic coating bath, which "burnishing" bodies roll and beat on the surface of the body or "mold" upon which the metallic layer is being deposited or has already been deposited while the electric current is turned on.

U.S. Pat. 1,236,438 issued Aug. 14, 1917 to N. Huggins discloses an apparatus for densifying electrodeposited material in which a roller positioned above the surface of the coating bath impinges upon the surface of a round body being coated as such body rotates out of the bath and wherein the surface is electroplated as the body rotates again down into the bath. Huggins states that for various reasons still undiscovered, but with which most of those skilled in the art are familiar, the metal deposited by the electrolytic bath is frequently spongy and unevenly deposited and his apparatus consolidates it.

U.S. Pat. No. 2,473,290 issued Jun. 14, 1949 to G. E. Millard discloses an electroplating apparatus for plating crankshafts and the like with chromium in which a curved anode partially surrounds the portion of the workpiece to be coated. The curved anode has orifices in its surfaces to allow the escape of bubbles formed during the coating process and also has extending through its surface, a support for a so-called positioning block or scraper block 54 which is provided to maintain a close spacing between the anode and cathodic workpiece. Millard states also that his spacing block removes gas bubbles from the cathode and also removes threads of chromium. He also states that the block, which has a significant width along the line of coating, dresses and polishes the cathode during plating. The aim of Millard, is clearly to burnish or compact the coating surface somewhat in the manner of the earlier Huggins patent. While Millard talks, therefore, about scraping off the gas bubbles and also removing "threads" of chromium by which it is understood that he means dendritic material, he is primarily interested in conducting a burnishing operation and spacing his cathode from his anode by his relatively wide spacer block.

U.S. Pat. No. 3,183,176 issued May 11, 1965 to B. A. Schwartz, Jr., discloses the electrolytic treatment or coating of a bore by use of a brush coating apparatus mounted on a drill press. The inside of the bore is acted upon by a series of centrifugally extended rotating vanes having dielectric outer covers.

U.S. Pat. No. 3,751,346 issued Aug. 7, 1973 to M. P. Ellis et al., discloses an arrangement by which a combined plating and honing procedure may be followed. In the arrangement, a plurality of honing stones are arranged to be movable into contact with the surface of the workpiece during the actual plating operation resulting in better surface characteristics, superior, it is said, to what was obtained before.

U.S. Pat. No. 3,772,164 issued Nov. 13, 1973 to M. P. Ellis et al., discloses the use of honing stones which hone the surface of a workpiece as an electrolytic coating is being applied.

U.S. Pat. No. 3,886,053 issued May 27, 1975 to J. M. Leland, discloses a method of electrolytic coating involving pulsing the current through an electrolyte containing a chromium plating solution while simultaneously performing a honing operation. It is disclosed by Leland that the honing of a chromium coating, for example, allows a high current density and faster deposition than the normal electrolytic tank process.

U.S. Pat. No. 4,125,447 issued Nov. 14, 1978 to K. R. Bachert, discloses the use of a brush attached to a movable anode within a hollow member being electroplated. The brush comprises a plurality of bristles made from plastic or other insulated material which rub against the inside surface of the tube being electroplated as the anode vibrates.

U.S. Pat. No. 4,176,015 issued Nov. 27, 1979 to S. Angelini, discloses the brushing of the surface of a series of bars as they are passed in a straight line through an anode immersed within an electroplating bath. The brushing is provided by a glass fiber brush comprising a blade having a layer of fiber scraping material compressed between side plates which is said to remove a cathodic film from the coated surface.

U.S. Pat. No. 4,210,497 issued Jul. 1, 1980 to K. R. Loqvist et al., discloses the coating of hollow members including movement inside the cavity of such members of an electrolytic solution by means of a "conveyor" which consists of a resiliently and electrically insulating material such as perforated, net-like or fibrous strip which is wound helically around a reciprocating anode. The function of the resilient electrically insulated material is to act as a conveyor of electrolyte, foam and gases which can be supplemented by forming the anode as a screw conveyor.

U.S. Pat. No. 4,595,464 issued Jun. 17, 1986 to J. E. Bacon et al., discloses the use of a so-called brush belt for continuously treating a workpiece. The brush belt is in the form of a continuous loop which passes over suitable rollers or pulleys and brings plating solution in the brush portion to the plating area. Essentially, Bacon et al. provides an absorbent belt which passes in opposition to the material to be coated.

U.S. Pat. No. 4,853,099 issued Aug. 1, 1989 to G. W. Smith discloses a so-called gap coating apparatus and process in which a relatively small elongated gap is established through which coating solution is passed at a high rate. It is said that the ultra high flow rate allows very high current densities. It is stated the process is not well suited for chromium plating, because high current densities do not increase the plating out of chromium.

U.S. Pat. No. 4,931,150 issued Jun. 5, 1990 to G. W. Smith, discloses a so-called gap-type electroplating operation in which a selected area of workpieces is coated by forming an electrode closely about such so-called gap and passing electrolytic solution through the gap at a high rate. It is stated that the ultra-high volume flow assures the removal of gas bubbles, the maintenance of low temperature and high solution pressure contact with the anode surface and a workpiece surface. It is stated that gaps approaching two and one half inches can employ the invention, but the gap would preferably be smaller, but at least 0.05 inches in width. It is stated that a fresh plating solution having a controlled temperature and no staleness is available at all times in the gap for uniform plating and while in high pressure contact with the surface of the gap. In practice, the plating solution is forced in a vertically upward direction so that any gas generated by the electrolysis in the gap migrates upwardly in the same flow direction as the plating solution is being driven and, therefore, can readily escape. It is also stated that chromium is difficult to use in the invention because chromium deposits slowly regardless of current density so that the deposition is slow and the advantages of gap plating are not fully attained.

While other processes and apparatus have, therefore, been available to remove hydrogen bubbles from cathodic coating surfaces, sever and remove dendritic material in coating processes such as the electrolytic coating of chromium and prevent depletion of the electrolytic solution and to some extent, establish a desirable coating gap between the coating electrode and the material being coated, all such prior processes have had drawbacks and none has been effective to accomplish all four or even two or three of the disclosed aims of the present invention by themselves.

OBJECTS OF THE INVENTION

It is an object of the present invention, therefore, to provide an apparatus which wipes the surface of a cathodic workpiece to remove hydrogen bubbles during continuous electroplating.

It is a further object of the invention to wipe the surface of a cathodic workpiece with a solid contact blade wiper to remove hydrogen bubbles from such surface.

It is a still further object of the invention to provide a solid wiper with an extended contact surface resiliently biased against the surface of a cathodic workpiece to detach bubbles of hydrogen and to encourage coalescence of a cathodic film into bubbles so that such bubbles can be removed on a subsequent pass.

It is a still further object of the invention to provide a substantially solid wiper blade biased against a cathodic work surface in a manner such that the solid wiper blade blocks forward movement of the electrolyte along the surface of the workpiece forcing used solution away from the surface and causing fresh solution to flow in behind the wiping blade, thus effectively forcing exchange of coating solution to prevent depletion of such solution.

It is a still further object of the invention to provide a substantially solid wiping blade having a restricted cross section and resilient so that the blade when biased against a cathodic coating surface in a flexed configuration bears against the surface and both dislodges hydrogen bubbles from such surface, blocks the passage of electrolytic solution past such resilient blade and steadies the material being coated.

It is a still further object of the invention to provide a substantially solid wiper having an extended contact blade biased against a cathodic work surface by resilient means which either biases the wiper blade in its own plane toward the coating surface or pivotably toward the coating surface.

It is a still further object of the invention to provide a substantially solid thin dielectric wiper between guide rolls in the continuous electroplating of flexible substrate material.

It is a still further object of the invention to combine a substantially solid wiper blade with a perforated anode adjacent to a cathodic work surface to maximize the efficiency of interchange of electrolyte by the wiper blades.

It is a still further object of the invention to provide a thin dielectric material acting as a supporting guide for flexible base material during electroplating in an electrolytic bath.

Additional objects and advantages of the invention will become evident from review of the following description and explanation in conjunction with the appended drawings.

BRIEF DESCRIPTION OF THE INVENTION

It has been discovered that a very effective acceleration of electrolytic coating plus the production of considerably better quality coatings can be attained by the use of a wiper blade or thin dielectric guide bearing upon continuous coating material, said wiper or guide blade having a substantially solid wiping or support edge portion which is resiliently biased against the cathodic coating surface. The blade itself may be resilient or it may be biased against the coating surface by associated resilient means while the cathodic coating surface moves relative to such wiping blade and also a closely spaced anode. Preferably the wiping blade is mounted upon the anode or even made a portion of the anode structure, but it may also have an alternative means for mounting. The wiper blade or guide blade effectively removes bubbles of hydrogen from the cathodic work surface and in those cases where dendritic material extends from the surface during the establishment of the coating, effectively severs such dendritic material and allows it to be removed from the coating vicinity. Dendritic material may extend from the coating during deposition, for example, in the production of chromium electroplated coatings and the like. The solid wiper blades also effectively block the passage of a surface layer or film of electrolyte next to the cathodic plating surface when such surface and a surface film of electrolyte are moving together relative to the main body of electrolyte and causes replacement of such surface film with new electrolyte, thus preventing gradual depletion of the surface layer of electrolyte. In a preferred arrangement, the wiping blade is combined with a perforated anode which allows ready escape of the depleted electrolyte layer and replacement with fresh electrolyte. The blade also may serve very effectively as a guide blade to support flexible substrate material to be electroplated between more widely spaced support rolls or the like. The very thin restricted surface of the guide blade does not interfere with the coating operation and adjusts itself to an increase of coating thickness as electrolytic coating progresses.

BRIEF DESCRIPTION OF THE DRAWING

FIG. 19 is a diagrammatic side view of a series of resilient wiper blades mounted in a sectionalized anode for use in continuous electrolytic coating of a sheet or strip.

FIG. 20 is a plan view of the top of the sectionalized anode and resilient wiper blade arrangement shown in FIG. 19.

FIG. 21 is a side or longitudinal view of one of the wiper blades shown in FIGS. 19 and 20 mounted in a sectionalized anode.

FIG. 22 is a side view of an alternative slotted wiper blade for use in the sectionalized anodes of FIGS. 19 and 20.

FIG. 23 is an isometric view of a preferred mounting arrangement for flanged anodes such as shown in FIGS. 19 and 20.

FIG. 24 is a diagrammatic view of a support or single hanger accommodating both a top and bottom flanged anode arrangement.

FIG. 25 is a side or longitudinal view of an alternative embodiment of a lead coated conductive cooper hanger or harness for the electrode and wiper blade assembly of the invention.

FIG. 26 is a diagrammatic side view of one embodiment of the electrode and wiper assemblies similar to those shown in FIGS. 23 through 25 in use on a line.

FIG. 27 is a side view of a hanger for the electrode and wiper blade arrangement shown in FIG. 25.

FIG. 28 is a sectional side or longitudinal view of an alternative flanged anode construction in accordance with the invention.

FIG. 28A is a sectional transverse view at right angles to the view in FIG. 28 of the alternative flanged anode arrangement.

FIG. 29 is a diagrammatic oblique view of the an alternative wiping blade arrangement in accordance with the invention.

FIG. 30 is a top view of one of the perforated flanged anodes shown in FIG. 29.

FIG. 30A is a diagram showing the staggered arrangement of orifice in the perforated flanged anodes shown in FIGS. 29 and 30.

FIG. 31 is a top view of an alternative embodiment of the arrangement of the invention shown in FIG. 29.

FIG. 31A is a diagram illustrating a preferred construction of the arrangement of the invention illustrated in FIG. 31.

FIG. 32 is an elevation of a T-shaped or section wiping blade in accordance with the invention.

FIG. 33 is a cross-section through the wiping blade shown in FIG. 32.

FIG. 34 is an end view of a holder or track for the T-shaped blade shown in FIGS. 32 and 33.

FIG. 35 is a broken away side view of T-shaped wiping blade and track as shown in FIGS. 32 and 33 in use wiping a strip surface.

FIG. 42 is a diagrammatic plan view of an improved embodiment of the perforated anode and chevron wiping blade of the invention.

FIG. 43 is a diagrammatic plan view of an alternative embodiment of the version of the invention shown in FIG. 42.

FIG. 44 is a diagrammatic plan view of an improved arrangement of the embodiment of the invention shown in FIGS. 32 through 36.

FIG. 45 is a side elevation of the modified T-shaped wiping blade used in the embodiment of FIG. 44.

FIG. 46 is a diagrammatic oblique view of the modified version of the T-blade shown in FIG. 45 arranged in the form it takes as shown in FIG. 44 with the blade mounted in the holders or tracks for such T-shaped section.

FIG. 47 shows a transverse section of the flexible, resilient slit T-section blades with a surrounding track for use in arrangements such as shown in FIGS. 44 and 46.

FIG. 48 shows a transverse section of an alternative version of the T-section blade with further alternative version of the T-section with surrounding track for use in the arrangement shown in FIGS. 44 and 46.

DESCRIPTION OF THE PREFERRED EMBODIMENTS

Figure 1A:
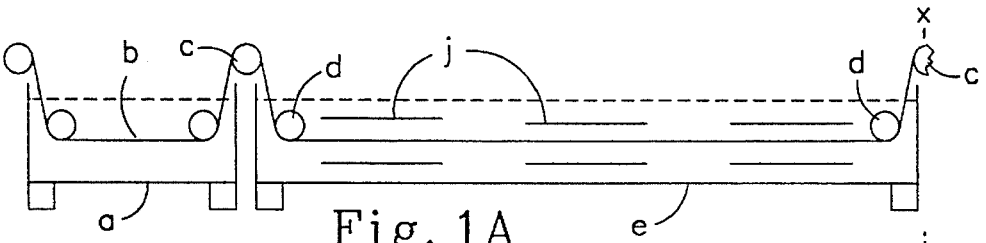
Fig. 1A Prior Art
FIGS. 1A and 1B are diagrammatic elevations of interconnected central portions of a typical electrolytic coating line wherein the improvements of the present invention may be used.

Various ways of removing hydrogen bubbles from the surface of a cathodic workpiece in an electrolytic coating bath or operation have been developed in the past which have in aggregate been effective to a certain limited extent, but which have left room for improvement. Likewise, various expedients to prevent electrolyte solution depletion have been developed to make sure that electrolytic coating solutions remain continuously fresh and ready to be plated from at their design composition. Most of such systems or developments have depended upon frequent changes of the electrolyte, forced circulation by pumps and the like during coating and frequent or continuous analysis of the electrolyte.

Likewise, it has been realized for many years that the rapidity and quality of electrolytic coating could be, at least theoretically, increased by spacing the electrodes as close to the workpiece surface to be coated as possible without breaking down the insulative quality of the intervening electrolytic solution and causing arcing between the electrodes and the workpiece, thereby damaging both the coated surface and the electrode itself. Where both the workpiece and the electrode are rigid pieces, such as in the coating of shafts, rolls, rods and the like that can be stabilized in a predetermined position and then rotated or otherwise moved past the electrode at a uniform distance, the choice of such distance may be determined by the relative concentration of the solution, the current density or amperage between the electrodes and the workpiece, the rapidity of movement between the electrode and the workpiece and other factors, plus the breakdown potential of the electrolytic solution. However, in the continuous coating of long lengths of sheet, strip, wire and the like, a further complication occurs in that the flexible material to be coated tends to oscillate or change its path of travel between supports usually over a period progressing to ever larger oscillations, thus forcing the coating electrodes to be more widely spaced from the workpiece to avoid possible arcing between the electrodes and the workpiece with consequent damage to both.

The present Applicants have discovered through careful experimental development that such previous systems can be considerably improved and, in fact, superseded, at least in those cases where there is a substantial extent of flat workpiece surface to be electrolytically coated, by the use of a novel, basically solid wiping blade section having an extended wiping blade surface which resiliently contacts the coating surface and lightly wipes and supports such surface along a relatively narrow line of contact. The arrangement is in its preferred embodiments not unlike that of a wind shield wiper on a car, but in which the cathodic work surface moves past a stationary wiper blade. The wiping blade is usually and preferably attached to or mounted upon an anode construction closely spaced to the cathodic work surface. The wiper blade, as it passes over the coating surface, is resiliently urged toward and against the work surface at one end or side where it dislodges hydrogen bubbles which have collected upon such surface and lightly guides or supports the coated material. The passage of the blade also causes small hydrogen bubbles to coalesce into larger bubbles which are more easily removed or brushed off by the wiper blade or by their own buoyancy spontaneously detached from the coating surface. It is also believed that the passage of the wiping blade causes the so-called cathodic layer or film, which is, it is frequently assumed, composed of a thin film of a mixture of uncoalesced hydrogen atoms and hydrogen or hydronium ions, to be partially dislodged and caused to also coalesce into small bubbles of hydrogen, whereupon such small bubbles further coalesce under the influence of the wiping blade either during the same passage or a subsequent passage of the wiper blade and are ultimately also displaced by the wiper blade. In those coating processes, furthermore, where the coating tends to send out or develop dendritic tendrils or processes from its surface, the wiping blades very effectively sever such dendritic material which, if not removed, has a preferential tendency to rapidly elongate or grow because it is closer to the anode and thus causes uneven coatings.

The wiper blade also, it has been discovered, very effectively causes rapid change or replacement of electrolytic coating solution next to the coating surface and, therefore, prevents depletion of the electrolyte which interferes with efficient and rapid coating and, in fact, may in many cases, cause not only uneven coating, but also otherwise defective coatings. As a workpiece passes through a coating tank or other solution container, it tends to carry along with it a thin layer of electrolyte which is separated from other electrolyte in the tank by a more or less definite boundary, which, while usually more or less turbulent, may transfer electrolyte across the boundary rather slowly. Since the plating out of the electrolytic coating takes place more or less exclusively from the thin layer adjacent the cathodic work surface and such layer is partially isolated or separated from the remainder of the electrolyte by the boundary established between the moving surface layer and the static main body of electrolyte, such thin layer rapidly becomes partially depleted of coating metal, inherently causing slower plating as well as other difficulties. A continuous coating operation, in fact, may establish an equilibrium in which actual plating is continuously being made from a partially depleted layer of electrolyte in which the concentration of coating metal is significantly less than in the rest of the electrolytic coating bath and not at all what analysis of the bath may indicate. It has been found that the wiper blades of the invention effectively cure this local depletion phenomenon and cause a substantially complete replacement of electrolytic solution next to the coating surface every time it passes a wiper blade. In this way, what may be referred to as the depletion layer, or barrier layer, is periodically and rapidly, depending upon the spacing of the wiper blades and the speed of the underlying cathodic coating surface, completely changed or replaced so that over a period, substantial differences between the analysis of the depletion layer and the analysis of the electrolytic coating bath as a whole does not develop resulting in a considerable increase in coating efficiency.

As the resiliently biased wiping blade passes over the cathodic coating surface, it flexes upwardly or outwardly so that it rides easily over the surface being coated or over increasing coating weights or thicknesses of coating, if there is a recirculation of the coating surface under the same blade. In addition, the flexing or resiliency of the blade, which causes it to basically merely lightly contact the surface, prevents such blade from wearing rapidly. The contact of the dielectric blade with the surface of the material being coated is sufficient, however, to damp out oscillations of the material being coated and since the dielectric blades are preferably extended from the anodes themselves, such blades serve very effectively to prevent the cathodic material being coated from approaching sufficiently close to the anode to cause an arc between them.

In a preferred arrangement of the coating blade, it may be attached to or closely spaced to a significantly locally discontinuous anode, such as an anode with fairly large or many small openings in it, a grid-type anode or other discontinuous anode which allows coating solution to flow through the anode both away from the front of the blade as the surface depletion layer approaches the wiping blade and back behind the blade as such blade passes by. In this way, the solution is always being periodically changed. The wiping blade construction of the invention has been found particularly effective in the deposition of chrome from electrolytic solutions, but may also be used in the electroplating of tin coatings, particularly for tin plate or so-called decorative metal coatings such as, in addition to chrome, nickel, cadmium, nickel and copper. Some potentially electroplated coatings such as zinc and the like can usually be more cheaply coated by so-called hot dip coating processes, if heavier coatings are desired, but the process of the invention is very effective for applying thin zinc or the like coatings.

The amount of pressure exerted upon the surface of the cathodic workpiece by the end or side of the wiper blade, which is bent in the same direction as the passage of the work surface, is related to the thickness of the wiper blade in the section contacting the cathodic work surface. The preferable nominal wiper blade thickness will be about 1/32 to 1/8 inch in thickness and the distance of the cathode surface from the electrode grid, may be between 1/8 and 1/2 inch or possibly up to 1 inch, but preferably within the range of about 1/8 to 3/8 inch and preferably about 1/4 inch. Consequently, the length or height of the wiper blade should be approximately 1/2 inch to 1.5 inches or thereabouts, depending upon the support arrangement, or in those cases where the spacing between the cathodic coating surface and the anode surface is greater than 1/2 inch, may be correspondingly greater. The wiper blades may be tapered from top to bottom to increase the flexibility of the blade and in these cases the above thickness dimensions apply basically to the throwing power of the electric field during the coating operation.

Figure 1B:
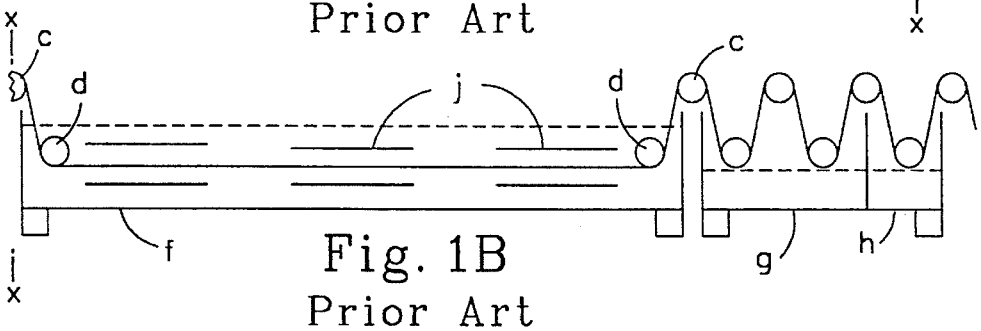
Fig. 1B Prior Art

FIGS. 1A and 1B are diagrammatic elevations of portions of the general arrangement of a typical prior art electroplating line in which the present invention may be used to increase the effectiveness and speed of the coating process as explained hereinafter. Commercial electroplating lines typically include a first payoff reel, or uncoiler, from which strip or sheet to be plated is paid off followed by buffing and cleaning operations plus any necessary or desirable bridles and looping towers, or accumulators to maintain a continuous strip supply plus tension in the strip. This apparatus is followed by rinsing tanks from which the strip or sheet is conducted through one or more plating tanks, through further rinsing operations and any special surface coating or finishing tanks and then recoiled or rewound, aided frequently by additional bridle rolls and looping towers, or accumulators. Plating may be accomplished in a straight through mode or in consecutive vertical runs over closely spaced vertically displaced guide rolls. FIGS. 1A and 1B show the central plating sections of a single dual tank straight through coating operation in which a rinsing tank "a" receives strip "b" to be coated from previous operations, not shown, and from which strip "b" is guided over contact guide rolls "c" through which electrical contact is made with the strip "b" and idler guide rolls "d" which guide the strip "b" into and through dual electrocoating or electroplating tanks "e" and "f" and then is conducted into further combined rinse and portion of the blade contacting the cathodic work surface. The normal bearing of the wiper blade upon or against the surface of the cathodic work surface will, therefore, be rather light and insufficient to burnish or polish the surface, but sufficient to detach any dendritic material extending upwardly into the bath from the cathodic work surface and to cause evolution of hydrogen bubbles from the surface and also sufficient to effect a significant guidance to the workpiece to prevent or damp out oscillations. It appears that the evolution of the bubbles involves more than mere detachment of bubbles already formed, but also involves a coalescence of very small or minute hydrogen bubbles upon the surface as well as in the form of a thin cathodic film, first into very minute bubbles and then rapidly, under the influence of the repeated contact with the wiper blades as the workpiece passes along the coating line, into larger bubbles which are displaced from the surface of the workpiece and rise through the liquid effectively removing them from the vicinity of the strip surface.

Since the wiper blades are very thin and preferably only the side of the end of the blade contacts the surface, only a minimum contact of the blade with the surface is involved so that a minimum interference with actual coating upon the surface occurs. Furthermore, since the wiper blades are very thin, in any event, and are made from a dielectric material, such blades have a very minimum interference with the electrical field between the anode and the cathodic work surface and thus minimum interference with the antitarnish coating sections "g" and "h" from which the strip "b" is then conducted to subsequent treatment and handling operations, not shown. While passing through the plating tanks "e" and "f" the strip "b" passes adjacent to or between a series of dual top and bottom anodes "j" which may be either consumable or nonconsumable depending upon the coating operation. The electrodes are desirably fairly closely and equally spaced from the strip "b" as shown to increase the plating speed and prevent differential coating, but must be maintained sufficiently spaced from the strip to prevent any chance of arcing between the cathodic strip and the anodes with resultant damage to both the strip and the anode. In general, the longer the unsupported run between guide, or idler, rolls in the plating tank or tanks, the more likely a flutter or deviation in travel of the strip will bring it too close to an anode surface and result in arcing. However, multiplication of guide rolls, while steadying the strip, also interfaces with coating. While two electro coating tanks are shown, any number from one to a substantial number of plating tanks can be used, depending upon construction and design of the line. The improvement of the present invention has to do with the coating apparatus including the anodes submerged within the electrocoating tank or tanks and is particularly directed to the use of resilient plastic wiping blades to periodically wipe the surface of the strip, preferably in combination with the use of perforated anodes mounted adjacent to the strip which is being electrocoated.

Figure 2:
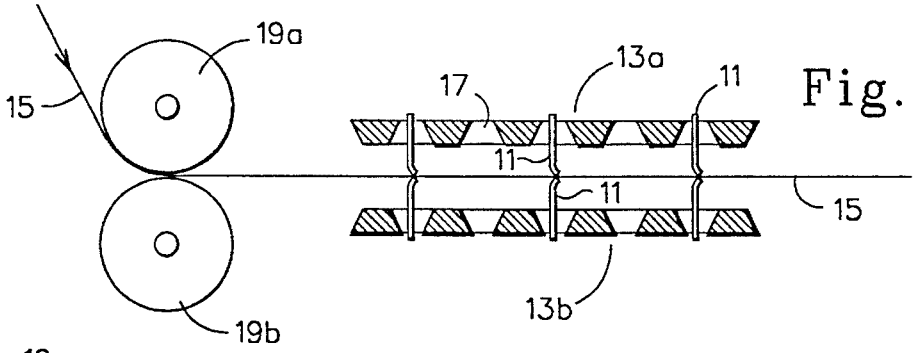
FIG. 2 is a diagrammatic partially sectioned side view of a portion of a continuous plating line showing the use of the dielectric wiping blades of the invention.

FIG. 2 is a diagrammatic side view of a basic embodiment of the invention in which a series of wiping blades 11 are mounted in a pair of grid-type anodes 13*a* and 13*b* positioned on the top and bottom, respectively, of a continuous strip 15 which passes between two pinch-type guide rolls 19*a* and 19*b*. The upper and lower anodes are perforated with openings 17 which allow for passage of electrolytic solution through them to reach the surface of the cathodic strip 15. The strip is guided by the guide rolls 19, only two of which are shown, and it will be understood there will normally be additional guide rolls as well as anodes beyond those shown as illustrated in FIGS. 1A and 1B. The ends of the wiper blades 11 are flexed against the surface of the strip as shown so that a light pressure is exerted against the strip, aiding in guiding it as well as wiping bubbles of hydrogen from the strip surface. The guide rolls 19*a* and 19*b* are customarily mere idler rolls and in many cases the idler roll 19*b* may be dispensed with.

Figure 3:
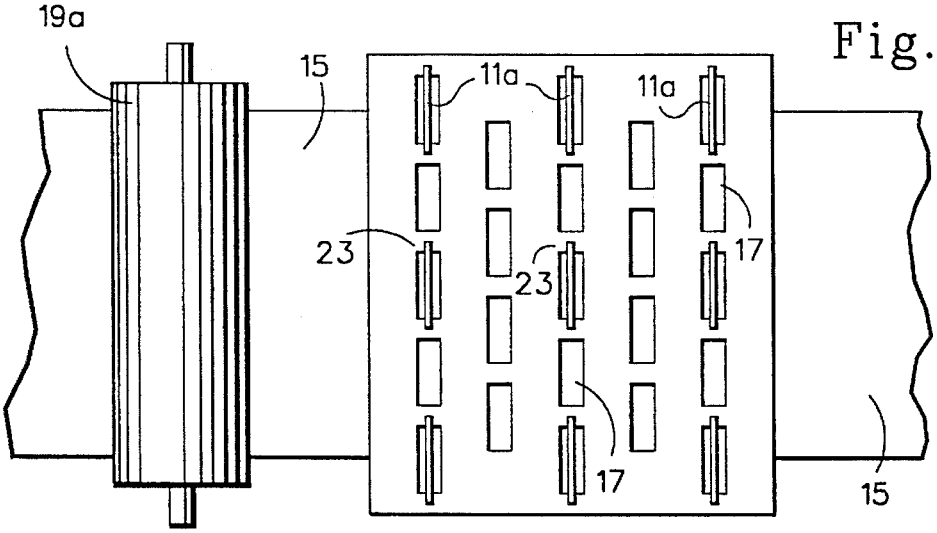
FIG. 3 is a diagrammatic top view of a portion of the continuous plating line shown in FIG. 2.

FIG. 3 is a diagrammatic top view of the arrangement shown in FIG. 2 in which the tops 11*a* of the wiping blades 11 are shown protruding partially through oblong or rectangular openings 17 in the anode 13*a*. The rectangular openings 17 are, as shown, preferably staggered or overlapping so that any given portion of the strip surface will not pass adjacent to a series of openings while adjacent portions pass always adjacent to solid portions of the anode, but will alternate regularly between open and solid sections of the anode.

Figure 4:
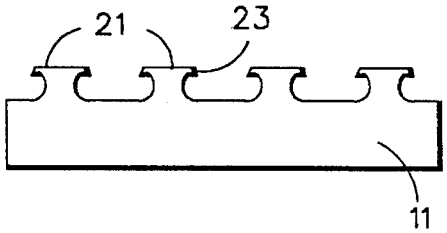
FIG. 4 is a side view of one embodiment of the wiper blades shown in FIGS. 2 and 3.

Preferably the top of the coating blades shown in FIGS. 2 and 3 are made, or formed, as shown more particularly in FIG. 4. It will be seen in FIG. 4 that the upper portion of the wiper blade is formed into a series of expansion-lock or snap sections 21 having outwardly expanded tops 23, which may be jam-fitted into the openings or orifices 17 of the grid-type anodes 13*a* and 13*b*. This construction allows the wiper blades to be quickly interlocked with the anode grid and to be simply and easily removed when the wiper blades 11 become worn and need to be replaced by new wiper blades. Normally the wiper blade 11 will be made by stamping out a series of the blades with the expanded top sections already formed upon them. However, it will be understood that various sections or shapes of the portion of the wiper blade which holds such blade in place may be formed depending upon how it is desired to attach the wiper blade to either the electrode, i.e. the anode, or to some other portion of the apparatus. FIGS. 5 through 11 discussed herein-after show one very effective alternative arrangement for fastening, and FIGS. 19 through 23 show a very desirable alternative. It has been found, however, that the wiper blades 11, however mounted, tend by their passage to coalesce very small bubbles into relatively larger bubbles which detach from the strip and float upwardly. It will be noted in both FIGS. 2 and 3 that the wiper blades 11 are spaced at fairly small intervals along the strip within the anodes. With the use of a series of blades fairly closely spaced, the first blade of a series contacted by a strip wipes away or dislodges large bubbles and tends to coalesce smaller bubbles into larger, which are then immediately wiped away or dislodged by the second closely following blade. In such case, however, there should be at least one other set of wiper blades. This is desirable because the dielectric wiper blades serve not only to wipe hydrogen bubbles from the coating surface and to interrupt passage of a surface layer of electrolyte about the workpiece but also to aid in centering the workpiece within the anodes to prevent the surface of the anode and the surface of the workpiece from too close approach and arcing with consequent damage to both the workpiece and the anode.

The wiper blades should be spaced so that bubbles of hydrogen, in particular, are wiped from the surface before any significant deposit or collection of such bubbles has been allowed to form. Consequently, the spacing of the wiper blades will be dependent to some extent, upon the line speed or passage of the workpiece and the rate of coating deposition, since a higher rate of coating, occasioned by a high current density between the electrodes will also normally form more hydrogen by electrolysis of the coating solution. Consequently, if the passage of the workpiece is rather slow, more wiper blades may be desirably spaced along the plating cell of the electroplating line. In FIGS. 2 and 3, the grid-type anodes 13*a* and 13*b* are shown with the wiper blades 11 inserted into the anode orifices 17 and bearing lightly upon the surface of the sheet metal substrate or strip 15 to both remove bubbles of hydrogen and also sever and remove any outwardly growing dendritic material extending from the coating surface. Such dendritic material will become a problem, which is neatly eliminated by the wiper blade of the invention, in certain electrolytic coating processes such as the electrolytic coating of chromium and the like on a cathodic work surface, for which the use of the wiper blade of the invention has been found to be particularly applicable, although such wiper blades are clearly applicable to the electrolytic coating of other metals as well.

FIG. 3, as explained above, shows an over-lapping or staggered pattern of orifices or openings in the perforated anodes so that instead of such electrodes 13*a* and 13*b* being orientated generally in the direction of the movement of the continuous strip through the apparatus, the openings are displaced transversely of each other. This ensures a continuously changing coating pattern as the cathodic workpiece passes between the grid-type electrode. When using regularly oriented grid-type electrodes, for example, certain parts of the cathodic workpiece being coated tend to remain under portions of the grid for greater periods than other sections, and this may tend to cause differential coating thicknesses across the width of the sheet, possibly requiring additional later treatment to even out the coating thickness. By overlapping the grid orifice pattern, however, the opportunity of the substrate surface to remain under an actual grid portion will, on the average, be evened out from one portion of the surface to another and a more even surface coating deposit will result. Of course, some patterns of grid orifices will be found more efficient than other patterns. For example, if the angle selected of one orifice displacement with respect to a following or adjoining orifice is 45 degrees, there may again be a tendency for certain portions of the cathodic work surface to, on the average, remain under an actual portion of the grid for longer average periods in the aggregate. However, if an exemplary angle between 45 degrees and 90 degrees is selected to provide the maximum similarity and average times of coverage by the electrode sections of any given series of adjacent portions of the work surface, a smooth uniform coating will be attained. The angle should also be arranged so that the jam-type interconnecting portions 21 of the wiper blades 11 can be conveniently forced into an opening between the grid members of the electrode. If a regular sequence of openings which will both hold the jam fittings of the wiper blade and also cause a random coating pattern with respect to any given time that the workpiece passes under any given portion of the coating electrode grid cannot be worked out, an alternative support for the wiper blades can be devised. It is possible, for example, for some of the jam-type interconnections to be removed where they may abut closed portions of the electrode grid rather than open portions, since it has been found that the jam-type interconnections are sufficiently strong so that a maximum number of interconnections between the wiper blade and the grid-type electrode through such jam-time interconnections is not usually necessary. Rather than angling a regular grid-type electrode, as shown in FIG. 2, the electrode itself can be made with random elements, so that there will be no regular pattern of passage of the electrode surface past the rapidly moving cathodic sheet metal substrate surface. Various other arrangements for supporting the wiping blade may also be provided.

The substantially solid wiper blade of the invention is used very effectively with the electrolytic coating of continuous elongated cathodic workpieces such as, for example, so-called continuous strip and sheet wherein the metal substrate is passed through an electrolytic coating bath containing an electrolyte containing dissolved ions of the metal to be plated out on the substrate. Large tonnages are produced, for example, of tin and chromium coated steel sheet and strip referred to respectively as tin plate and tin free steel or TFS, which has a very thin coating of electrolytically applied chromium plus chromium oxide applied to its surface. These coatings are made in either a straight pass through very long plating tanks such as illustrated in FIGS. 1A and 1B or in a multiple vertical pass line over guide rolls within a plating line. The outer oxide surface is applied by varying the coating conditions.

Normally, the cathodic workpiece and the anode are maintained a fair distance apart in such lines depending upon the support of the strip to prevent touching or very close approach of the cathodic workpiece to the anode, which close approach may cause arcing with serious consequences not only to the strip, but also the the anode. The longer an unsupported length of strip that is passed by the anode, the greater chance for substantial deviation of the strip from its pass line and possible impingement upon the anode. A multiple vertical pass line arrangement over support rolls in the coating bath offers more support usually as well as additional pass line compressed into a coating tank of any given length and has been frequently used on this account. However, even a multiple vertical pass line arrangement is subject to possible swaying or vibration of the strip passing between the guide rolls and the distance of the strip from the cathodic work surface is thus seldom maintained less than about one to one and a half inches from the anodes on both sides, although specialized installations having a closer gap have been used. The present inventors have found that by the use of their dielectric material wiping blade, they are able to not only efficiently wipe hydrogen bubbles from the cathodic coating surface as well as effectively sever dendritic material extending from the surface in the case of a thicker coating, but also to very effectively wipe any surface layer of partially depleted coating solution from the coating surface, thus effectively preventing depletion of the coating solution next to the cathodic coating surface, but in addition by the use of their wiping blades, are enabled to steady or guide the strip traveling past the anode and thus prevent too close an approach and arcing between the anode and the Strip. By the use of the thin dielectric blade of the invention serving as a guide blade, therefore, closer spacing of the anodes to the continuous strip may be had with a resultant increase in throwing power.

Figures 5A, 5B, 7, 8, 16, 17, 18:
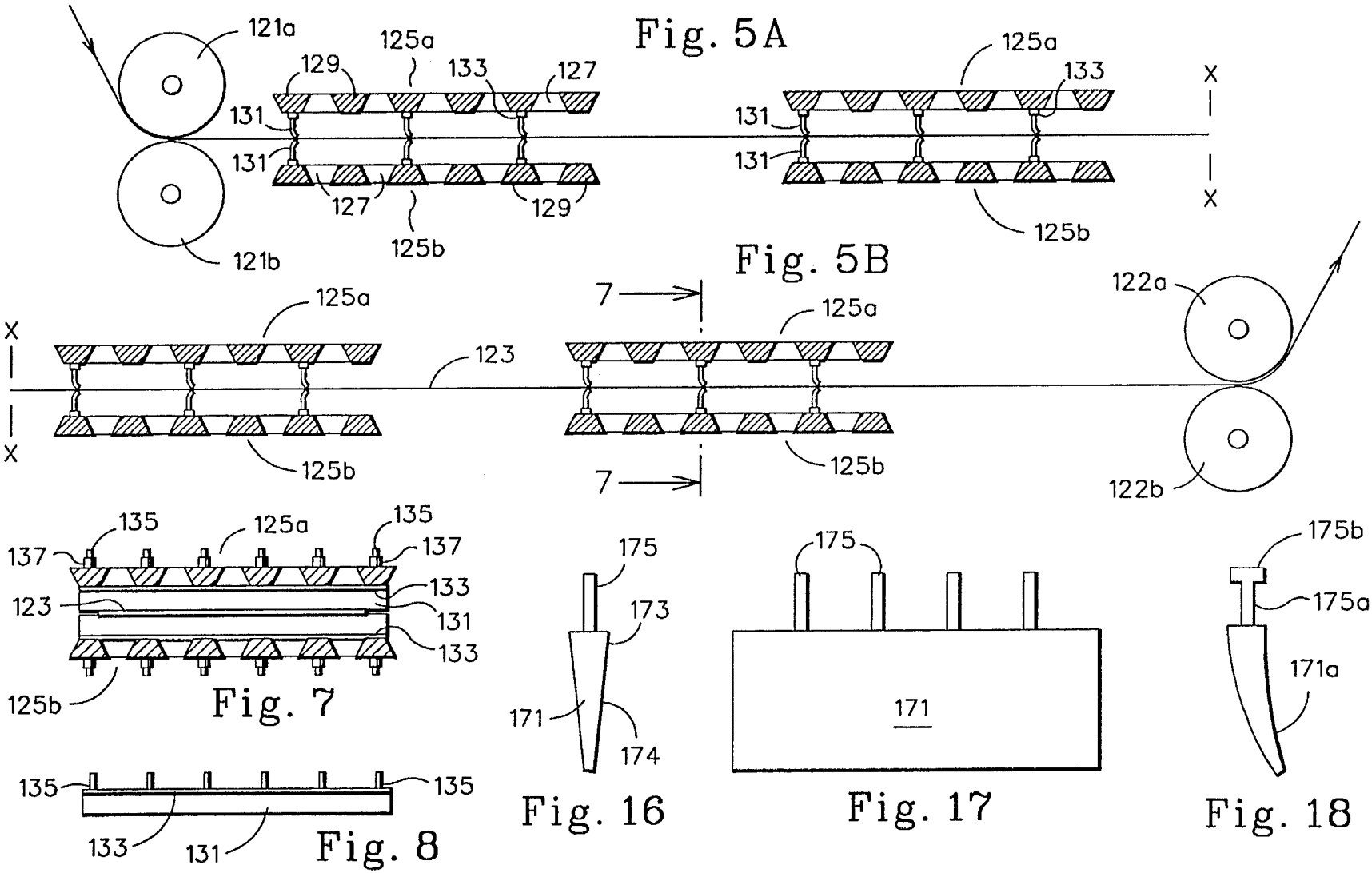
FIGS. 5A and 5B are diagrammatic elevations of a continuous plating line equipped in accordance with the invention with an alternative form of the wiper blade of the invention.
FIG. 7 is a transverse section through the portion of the continuous coating line of FIG. 5B at 7—7.
FIG. 8 is an enlarged view along the length of one of the wiper blades used in the continuous coating line shown in FIGS. 5A through 7.
FIG. 16 is an end view of an alternative tapered wiping blade in accordance with the present invention.
FIG. 17 is a side or longitudinal view or elevation of the tapered wiping blade shown in FIG. 16.
FIG. 18 is an end view of an alternative tapered construction wiping blade in accordance with the invention.

FIGS. 5A and 5B are diagrammatic side elevations of a so-called tin-free steel, or "TFS" line, for coating blackplate with a thin, almost flash coating of chromium plus chromium oxide. The chromium oxide is usually applied in a different cell or tank. Guide rolls 121*a* and 121*b* and 122*a* and 122*b* convey a strip 123 of blackplate, i.e. uncoated steel strip or sheet material, straight through a tank, not shown, in which the coating operation is confined in a body of electrolyte between pairs of anodes 125*a* and 125*b* formed in a grid configuration with longitudinal elements 127 and transverse elements 129 shown in section. As shown, the individual members or elements of the grid-type electrode have a truncated triangular shape slanted toward the strip surface and providing additional surface area to increase the anode surface area exposed to the electrolytic solution particularly in the direction of the workpiece or strip surface, assuring at least a 1.5 to 1.0, or greater, anode to strip surface ratio. The top anodes 125A and bottom anodes 125B are spaced within about one half to three quarters of an inch of each other with the strip 123 passing between them. Alternating transverse elements of the anodes are provided with resilient plastic wiper blades 131 which are attached to or mounted upon such transverse elements as shown, by essentially threaded plastic fittings, but could be mounted in the openings of the grid equally well, as shown in FIGS. 2 and 3. As in the previous views of other embodiments, the wiper blades are slightly longer than the space between the strip surface and the anode surface so that the blade is partially flexed during continuous plating operation. It is believed preferable for the blade to be flexed just sufficiently to enable its end or side to ride upon the surface to be coated along one edge. In other words, the wiper is preferably cut straight across at the bottom so that when flexed, it rides with an edge or corner of one side against the strip surface and wipes off all bubbles of hydrogen as well as any thin cathodic layer which tends to form. The coating in a continuous coating line is not usually sufficiently thick for dendritic material to begin to grow or extend from the surface. However, if the electrolytic coating is one upon which dendritic material tends to grow from the surface, the edges of the blades also very neatly shear off such dendritic material so it does not interfere with the uniformity of coating. However, as noted, in the coating of continuous black plate or strip, the coating usually is not allowed to become thick enough for any dendritic material to form. The principal function of the wiping blade, therefore, in the process shown in FIGS. 5A and 5B is first to detach bubbles of hydrogen from the coating surface, second to divert any thin electrolyte depletion layer or film that may otherwise tend to travel along with the strip and third, to offer resistance to oscillations of the strip or to guide the strip between the coating electrodes. Thus, as a thin surface layer of electrolyte travels through the apparatus with the strip, it contacts the stationary wiper blade which is resiliently held against the strip with sufficient force to prevent it from being displaced or lifted away from the strip by the force of the electrolyte being carried or dragged along with the moving strip, but not with such force that it will not be easily lifted by the coating building up on such strip in order to prevent the coating from being damaged by the wiper blade. The stationary wiper blade thus diverts or displaces away from the surface of the strip the thin layer of electrolyte that is usually carried along with the surface of the moving strip. The displaced layer of coating solution is displaced not only sidewise along the blade, but also partially upwardly through the openings in the anode grid in front of the wiper blade. At the same time, fresh solution enters the space between wiper blades from the sides and also from the top through the openings in the electrode grid behind the blade. If the anode is more than a few inches wide, the entrance of electrolyte from the side would not be sufficient to prevent cavitation or temporary and fluctuating open spaces behind the blade and it is, therefore, important that the wiper blade be used in combination with a perforated anode, particularly as the opening or clearance between the perforated anode and the metal substrate or strip is only on the order preferably of about one quarter to three eighths of an inch in order to attain maximum efficiency. The thin dielectric flexible or resilient blade also very effectively stabilizes the position of the strip with respect to the anodes.

The wiper blades 131 are shown in FIGS. 5A and 5B as having an upper mount 133 into which they extend or which is integral with the blade itself and such upper mount is then attached, preferably directly to the anode, by threaded fasteners which may pass through fastening openings in the anode and may be secured with a threaded nut. It is preferred to have the upper mount 133 made from the same electrolyte-resistant dielectric plastic and to have the threaded fastener 135 in the form of a stud made from the same plastic material or other plastic material which may be threaded into the upper mounting block on one end and have the other end passed through an orifice in the lead or other composition anode and secured by a threaded nut 137 as shown most clearly in FIG. 7.

Other forms of securing mechanism or means for the wiper blades can be used, such as, for example, the interengagement means shown in FIGS. 2 and 3 which comprise partially expanded jam fit means which may be an integral part of the upper section of the blade material itself. The expanded sections 23 shown in FIGS. 3 and 4, of course, operate best if the openings in the grid-type electrode are approximately the same size both longitudinally and transversely as the dimensions of the snap-type jam fittings on the blade itself. Since the material of the blade is desirably rather thin in order to attain satisfactory flexibility in a short length, such as the close spacing of the cathodic workpiece and anode surfaces demands, an orifice in the anode both large enough to provide the necessary electrolyte flow from top to bottom and vice versa, may be difficult to arrange, particularly if it must also be the correct size for maintaining a secure interlock with the upper portions of the blade. The use of the threaded securing means shown broadly in FIGS. 5A and 5B, and more particularly in FIGS. 5 through 12 described below, thus is desirable, so far as preciseness and noninterference with the openings in and flow of electrolyte through the anode is concerned. A combination flanged sectionalized anode-slotted wiping blade assembly, shown more particularly in FIGS. 19 through 23 described hereinafter, is also very desirable.

Figure 6:
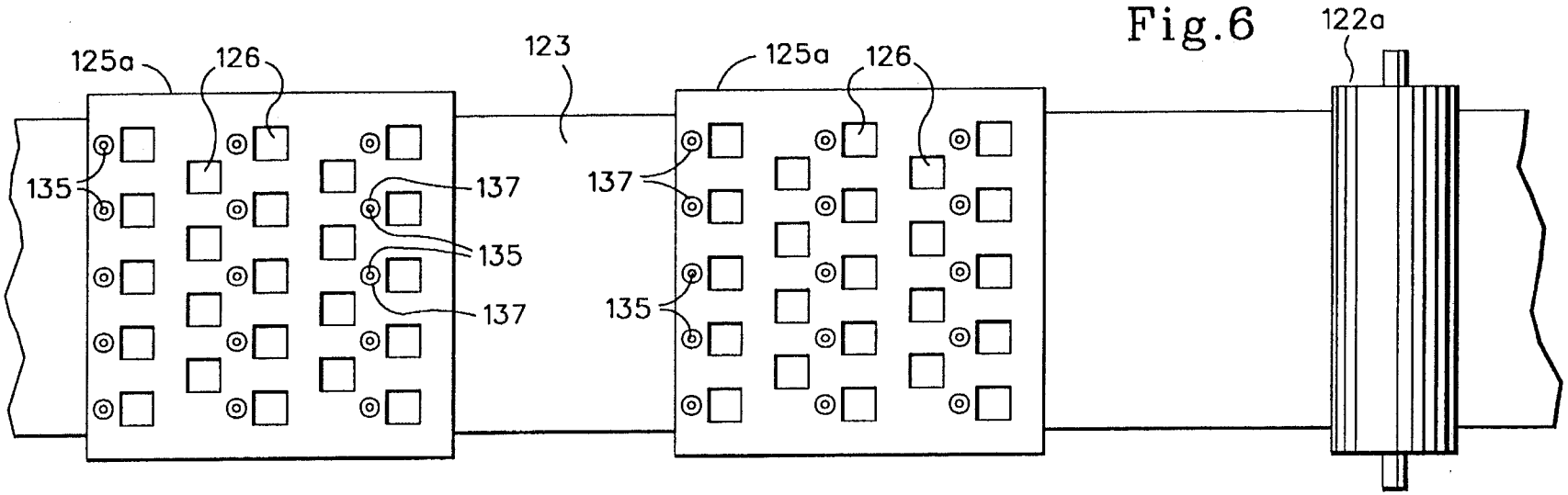
FIG. 6 is a diagrammatic plan view of the portion of the continuous coating line shown in FIG. 4B.

FIG. 6 is a diagrammatic plan view of the arrangement shown in FIG. 5B showing the top of the grid-type electrodes 125*a* positioned over the strip 123 plus one of the guide rolls 122*a* at one end of the plating tank, the tank itself again not being shown. The openings or orifices 126 in the tops of the grid-type anodes are clearly visible as are the tops of threaded fastenings 135 and threaded nuts 137 upon them which hold the upper mounts 133, shown, for example, in FIG. 9, of each of the wiper blades 131 against the lower surface of the upper anode 125*a*. The same arrangement is present upon the upper surface of the lower anode 125*b*, not shown in FIG. 6.

Figure 9:
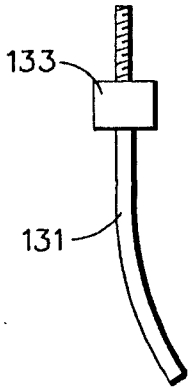
FIG. 9 is an enlarged end view of the wiping blade of FIG. 8.

FIG. 7 is a cross section transversely through upper and lower grid-type electrodes 125*a* and 125*b* as well as the strip 123 along the section 7—7 in FIG. 5B showing the wiping blades of the invention bearing upon the surface of the strip, while FIG. 8 is a side view of one of the wiper blades by itself prior to being affixed in place or secured to one of the anodes as shown in FIG. 7. FIG. 9 is an enlarged end view of the wiper blade 131 and mounting 133 shown in FIG. 8 by itself and shown in FIG. 7 mounted in place in the coating tank, not shown. The coating blade 131 is illustrated in FIG. 9 with the minor flexure which is preferred when the blade is in operative position against the strip, but it should be recognized that the blade will normally, when free standing by itself, as shown in FIG. 9, be straight rather than flexed so that when it is contacted against a surface to be coated, it will exert a small but definite back force against the surface to be coated. Such force should be sufficient, as noted above, to thoroughly remove as well as coalesce hydrogen bubbles clinging to such surface and, it is believed, nucleate into small hydrogen bubbles any cathodic film clinging to or laid down upon such surface. In addition, in the case where there is dendritic material forming upon such surface, the force of the blade should be sufficient to sever, shave off or otherwise remove such dendritic material, while at the same time not bearing upon the surface sufficiently to prevent buildup of the coating and/or to burnish or damage the coating. The degree of force should also be sufficient to prevent the surface layer of liquid electrolyte drawn along with the moving strip from lifting the wiper blade from the surface as the result of the force building up in front of and under the blade, since this would allow the potentially partially depleted surface layer of electrolyte normally drawn along with the strip or other workpiece to pass at least partially under the blade to the opposite side of the wiper blade, rather than being diverted from the surface and replaced by fresh electrolyte flowing in behind the blade as the strip passes under the blade. The wiper blade or dielectric guide blade should also be sufficiently flexible, as explained, to resiliently support the material being coated against transverse oscillations and other movement allowing closer spacing of the anodes to the cathodic workpiece along wider stretches between actual guide or support rolls which otherwise decrease actual electroplating space. The parameters of the resiliency of the blade, therefore, are essentially the generation of sufficient force, due to resiliency either of the plastic itself or of a separate resilient biasing means, to prevent any substantial escape of liquid electrolyte under the blade and to sever thin dendritic processes, if any are present, and to guide and prevent oscillation of the cathodic workpiece, but not sufficient to mar the coated surface or to prevent the necessary buildup of an electrolytic coating of the thickness desired upon the surface. A blade which will resist lifting by the surface layer of fluid will usually also be effective to remove bubbles of hydrogen as well as nucleate smaller quantities of hydrogen into bubbles. An immovable, or non-resilient, blade would simply constrict any upward buildup of coating, a very undesirable situation. An immovable blade would also rapidly wear. The resiliency should also be sufficient to prevent or damp out any substantial oscillation or weaving of the strip between the sets of guide rolls 121 and 122 in a continuous coating line such as shown in FIGS. 5A and 5B and prevent possible touching and arcing of the cathodic workpiece or strip with the anode. Arcing can, of course, also occur if the anodic and cathodic surfaces approach close enough for the potential between the two to break down the natural resistance of the intervening electrolyte except by ion transport of the electric current. It is for this reason also that the wiping blade itself should not be a conductor of electricity or have a low dielectric value and should be sufficiently stiff to provide substantial and effective guidance and directional stability to the workpiece, particularly when in the form of a flexible strip or the like.

While it is preferred to rely upon the resiliency of the narrow, thin wiping blade itself to produce sufficient force to prevent lifting of the blade from the surface of the workpiece by the force of the electrolytic solution upon side of the blade and to maintain the strip centered between the electrodes, other resilient arrangements to accomplish basically the same end may be used. For example, in FIG. 10 there is shown a wiper blade 141 which is maintained straight up and down, or essentially at right angles to the coated surface, while being resiliently biased toward the cathodic surface by resilient means in a mounting 143. In this case the resilient means comprises spring means 147 in a spring chamber 145 within the mounting piece 143 isolated or blocked off from the electrolyte bath by a movable plunger 149 in which or to which the wiper blade 141 is mounted. The plunger 149 is essentially similar in structure, though not in its entire function, to the mounting 133 at the top of the wiping blade 131 as shown, for example, in FIGS. 7, 8 and 9.

Figure 11:
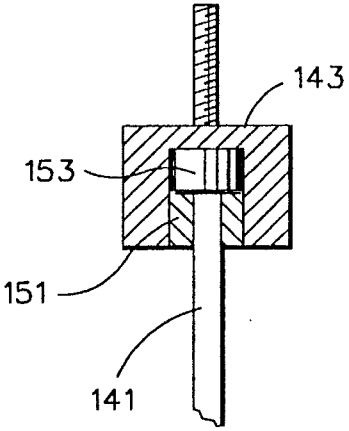
FIG. 11 is a transverse section through a still further alternative wiping blade of the invention.

A third type of resilient construction is shown in FIG. 11. In this arrangement, the wiper blade 141 passes into a slotted member 151 in the mounting 143 and abuts against a resilient plastic material contained in a resiliency chamber 153. The resilient plastic or other resilient material such as rubber or the like may be contained in the resiliency chamber 153. Such material is more resilient than the polymeric dielectric material of the wiping blade itself and is calculated to provide the resilient force necessary as explained above.

Figure 10:
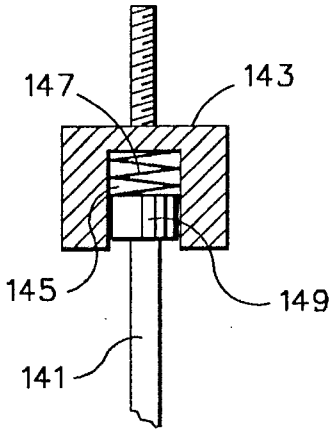
FIG. 10 is a transverse section through an alternative wiping blade.
Figure 12:
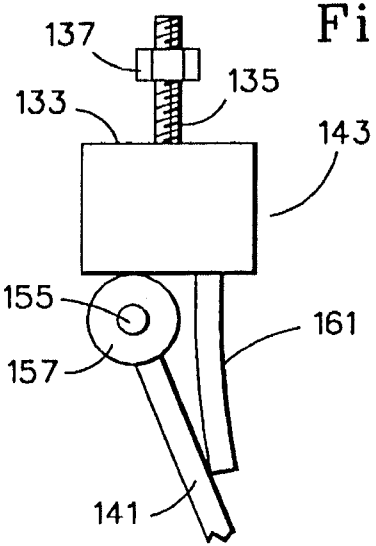
FIG. 12 is an end view of a still further alternative construction of a wiping blade in accordance with the invention.
Figure 13:
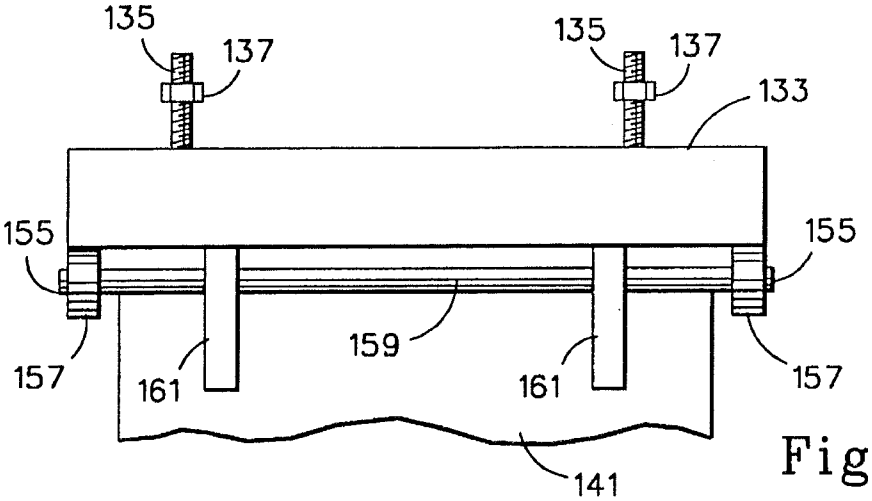
FIG. 13 is a side view of the wiping blade shown in FIG. 12.

A fourth type of resilient construction is shown in FIGS. 12 and 13 which disclose a construction in which a fairly stiff plastic or dielectric blade material comprises the wiping blade 141, as in FIGS. 10 and 11, but in which the wiping blade 141 is hinged to the mounting member 143 by means of two bosses 155 at each end of the top of the blade, which bosses 155 are accommodated in two plastic loops 157 dependent from the mounting member 143. The bosses 155 may, in the construction shown, be continuations or extensions of bar or shaft 159 at the top of the blade 141 as shown, or may be extended directly from the sides of the blade 141 itself. The blade 141 will, in the arrangement shown, merely pivot on the mounting 143, and in order to provide a resilient force of the end of the blade against the strip surface, a further resilient biasing means is necessary. This is shown in FIGS. 12 and 13 as being supplied by two resilient strips of plastic 161 which are securely mounted in or attached to the mounting 143 and bear against the face of the blade 141 to bias it with a resilient pivoting force. In each of these embodiments, threaded fastener means shown as a threaded stud or other threaded fitting 135 together with a threaded nut 137 received upon said stud are used to secure the various resilient wiper blade constructions directly to the anode. See in particular, FIGS. 7 and 8. However, in each case, the blades could be secured to a separate mounting or the like rather than directly to the anode.

Figure 14:
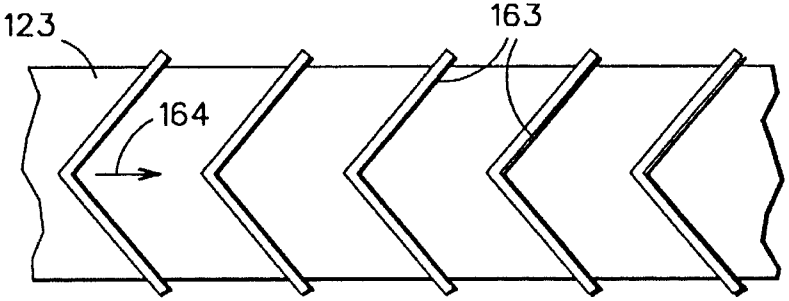
FIG. 14 is a diagrammatic plan view of an alternative form of wiping blade superimposed upon a strip being coated.

FIG. 14 shows a further design for a wiping blade in which a series of blades 163 are arranged in a chevron or triangular overall shape along a coating substrate 123 such as, for example, black plate or the like, which will be drawn past the chevron shaped blades in the direction of the arrow 164. The blades 163 will be either self resilient or may be biased toward the strip by a spring or other arrangement, not shown, but essentially as explained above. The individual chevrons may be either separately mounted or supported or may be mounted or supported in a single frame, not shown, which is resiliently pressed against the strip surface in any suitable manner. The mounting or attachment of ganged or individual chevrons, as in the other embodiments of the wiping blades, can be either directly to the closely spaced anodes, not shown, or to separate mounting means so long as the mounting is secure and, as explained above, properly resilient.

Figure 15:
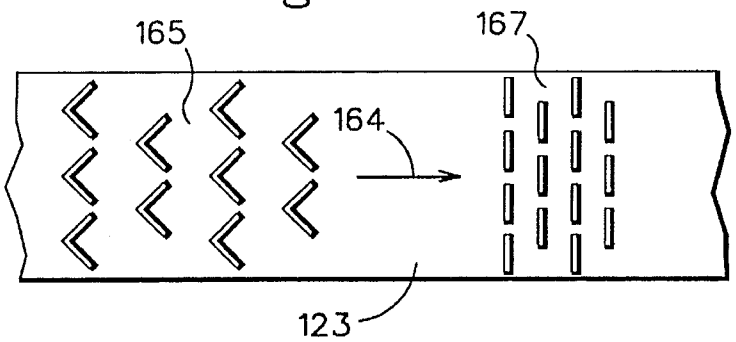
FIG. 15 is a still further diagrammatic plan view of two alternative configurations of wiping blades in accordance with the invention superimposed upon a strip being coated.

FIG. 15 is a diagrammatic plan view of a strip of black plate 123 as shown in FIG. 13, with two further possible arrangements of solid wiper blades applied to the surface of the strip as shown. As in FIG. 14, the movement of the strip 123 is in the direction of the arrow 164. In the first of these arrangements, a group or collection of chevron-shaped blades 165 extend across the strip to wipe the surface, removing hydrogen bubbles and also renewing the surface layer of electrolytic solution primarily by breaking up such surface layer. In the alternative arrangement 167 of straight, but relatively short wiper blades, the strip face is again wiped by a series of individual blades. In both arrangements, the blades, both chevron and straight, are staggered so that electrolytic solution is directed essentially from one blade to another thoroughly mixing it and essentially causing turbulence, but not necessarily stripping the entire coating surface at one time of its associated electrolytic solution. The arrangement is particularly useful where perforated, or grossly perforated, anodes may not be readily available for use with the blades or where it is desired to have a more gradual replacement of the surface layer of electrolytes. No mounting structures are illustrated for the blades shown in FIGS. 14 and 15, but it will be understood that suitable mountings or hangers would be present.

When chevron-shaped wiping blades are used, the angled blade tends more forcefully to force the electrolytic solution to the side, somewhat in the manner of a snowplow. This is somewhat more effective in immediately removing any dendritic material from the coating surface, but probably does not interchange electrolytic solution any faster, since there must be sufficient openings in the anode to allow ready back flow of solution behind the wiper blade to avoid cavitation, which openings are then also adequate to allow flow from in front of the blade. However, several improved embodiments allowing faster replacement or interchange of electrolytic solution are described hereinafter. Despite the angle of the blade in the snowplow arrangement, movement of the work surface past the blade can still be properly considered to be substantially transverse with respect to the blade.

FIGS. 16 and 17 are end and side views, respectively, of an improved tapered wiping blade 171 in which the top portion 173 of the blade is expanded in size and preferably has a series of thin pins 175 extending from it. This blade can be attached to an anode by inserting the pins 175 into pre-drilled holes in adjoining anodes and when it is desired to replace a blade, such blade can be easily pried out of its mounting with a prying tool of proper design and a new blade popped into place. The lower portion 174 of the blade 171 is tapered so that it is properly flexible or resilient to bear against the surface of the coating substrate or strip and may be pre-flexed, if desired, in the proper direction.

FIG. 18 is a side view of a further wiping blade 171*a* also having a tapered and pre-flexed contour and having, in addition, a pin 175*a* having a slight expansion 175*b* at the top so that when popped into place in pre-drilled holes in the anode or other mounting, it will be held securely in place until pried out after wear of the end of the blade is detected. Alternatively, if the enlarged top is made larger together usually with the pin itself, the enlarged pins may be jammed into the flow orifices in the anode to hold the blade somewhat as shown in FIGS. 2 and 3. However, this has the disadvantage of blocking the flow orifices in the area in which flow may be most desirable to renew the electrolytic solution.

As has been explained above, the resilient plastic or dielectric wiper blades of the invention very effectively wipe the surface of a cathodic workpiece while electrolytic coating is taking place by relative movement with respect to the surface of the coating piece. Normally, the wiping blade will be held stationary, but resiliently biased against the workpiece, as shown in the various appended drawings, but it will be understood that the wiper blade can be designed to move across the work surface also. Usually in such case there would be a reciprocating motion of the wiper blade or blades somewhat in the manner of a windshield wiper on a car. In most such instances, a fairly stiff blade may be used and depended directly against the coating surface by a resilient means.

In FIGS. 19 and 20 respectively, there are shown a diagrammatic side elevation and a diagrammatic plan view of a perforated anode and plastic wiping blade combination construction for use in the continuous plating of strip or sheet. As shown, a single anode 195 may be divided or sectionalized, for example, into four more or less equal sized sections 195*a*, 195*b* and so forth with upstanding flanges 197 between the sections between which dielectric wiper blades 199 are mounted and secured by the same fastenings as secure together the flanges. Such flanges 197 and wiper blades 199 are thus connected or secured together by means of fastenings 201, which may be threaded or other suitable fastening. Additional anode sections may extend on either side of those shown in the figures to form whatever sectionalized anode length is convenient or desirable. The lengths of the anode sections 195*a*, 195*b* and so forth are preferably equal and are arranged so that the wiper blades 199 are positioned opposite to each other along the strip 123. The sectionalized arrangement not only provides an integrated structure, but a stronger structure overall, and if the wiping blades are slotted, allows such blades also to be adjusted periodically for wear, although as noted, wear is generally not very rapid because of the flexibility of the blades. The wiping blades can also be reconditioned by use of a special reconditioning tool which can shave off worn or contaminated surfaces of the wiping surface of the blade. Each anode section is provided with a plurality of more or less randomly, but closely spaced orifices 203, best shown in FIG. 20, through which coating solution may have free passage, particularly, as explained above, as the wiper blades 199 force a surface layer of solution away from the surfaces of the traveling strip 123. As explained previously, such solution will be forced by the movement of the strip past the wiping blade out the sides of the spaces between the anodes and the workpiece between the blades, but also up through the anode orifices in front of the blade, while other solution passes through the orifices at the back of the wiping blade as well as in from the sides to take the place of the previous solution, thus ensuring a periodic renewal of the electrolytic solution next to the surface of the workpieces.

As in earlier figures, the wiper blades are shown inclined slightly in the direction the workpiece surface is moving. Preferably one edge of the end or side of the wiper blade contacts the surface of the workpiece. This very effectively strips the barrier layer of solution and hydrogen bubbles away from the surface of the moving substrate.

As indicated above, the arrangement shown in FIGS. 19 and 20 is a convenient way to allow adjustment of the wiper blades as wiping proceeds. In FIG. 21 there is shown a longitudinal view of one of the wiper blades 199. In FIG. 21 the wiper blade 199 has round orifices 191 in it through which the fastenings 201, shown in FIG. 19, may be passed to hold the wiping blades tightly between the flanges 197 of the anode sections 195. The wiper blade is not adjustable, but is strongly and securely held in place. On the other hand, in FIG. 22 there is shown a variation of the wiper blade designated in FIG. 22 as 199 having oblong orifices or slots 193 through it for receipt of the fastenings 201. The slots 193 are preferably spaced several inches apart. The slotted arrangement of FIG. 22 enables the blade to be adjusted vertically between the flanges 197 as the wiping blade wears. It will usually be the case that the anode will be withdrawn from the coating solution for adjustment of the wiper blade, but in some cases a suitable mechanism, not shown, for periodic adjustment of the wiping blade may be mounted upon or adjacent to the top of the blade to make an automatic adjustment or even a manual adjustment of the wiper blade without removing the entire structure from the coating solution.

As will be understood, the combined anode-wiper blade structures shown in FIGS. 19 through 22 provides a strong convenient and highly practical arrangement which has several advantages over the wiper blade construction shown in previous views. The arrangement is particularly sturdy and effective in securely holding the wiper blades in position. Its main disadvantage is that the blades are not readily replaceable without disassembling the entire structure, although, as indicated, arrangements can be made for moving slotted or otherwise appropriately constructed wiping blades to adjust them automatically or at least manually without removal of the anode from the coating solution. Such arrangements, however, create additional complexity and the more conveniently replaced snap-in-type wiping blades shown in some previous views may be, therefore, more desirable in some operations.

FIG. 23 is a diagrammatic isometric view of an anode suitable for use with the present invention in which a flanged anode 225 which may be constructed out of lead, lead-tin alloy or the like is secured to two copper supporting structures or hangers 227 composed of horizontal sections 229 and vertical sections 231 which serve to connect the flanged anode 225 to the supporting and electrical structure of the coating line. Only the back vertical sections 231 of the hangers are shown on the right. Normally, however, there would be similar vertical sections on the left side of the hanger. The perforated anode 225 has orifices or perforations 233 across its entire surface which orifices extend completely through the anode as explained previously. This enables electrolytic solution to pass freely through the anode and allows not only better solution of the anode where the anode is a sacrificial anode, but also better circulation of the electrolytic solution. The orifices 233 shown in FIG. 23 may be of various shapes and sizes, depending on the particular circumstances or requirements. Previously shown orifices in earlier figures have been mostly either square, round or oblong in a transverse direction. Such orifices may also be oblong in a longitudinal direction with respect to the passage of linear materials such as strip, past the anode. Since it is advantageous for the openings or orifices 233 to be placed in an overlapping pattern, however, it will usually be more convenient to have oblong orifices extending in a transverse direction, since it is with respect to the transverse movement of the strip that it is desirable to have the orifices aligned in an overlapping pattern. This prevents any given portion of the strip from tending to spend more time than other portions under or immediately adjacent to a solid portion of the anode rather than a perforated portion of the anode.

Since it is not desirable to have the electrolytic solution dissolve the copper hangers, such hangers should be coated with lead, lead-tin or other suitable resistant material to prevent dissolution. The exact composition of the anode and the covering for the copper anode hangers will depend on the particular electrolytic bath which is being used.

FIG. 24 is a diagrammatic isometric view of one side of a single hanger 228 provided with two crosspieces or cross members 229*a* and 229*b* which serve to support both the top and bottom lead anodes adjacent to the strip surface as the strip passes between the two cross members as shown. In this case, there are, of course, two perforated anodes 225*a* and 225*b* attached to the two cross pieces and it will be understood that the opposite end of such anodes would be attached to a second copper hanger or support as shown in FIG. 23 for a hanger provided with a single crosspiece. Likewise, in FIG. 24 the usual left-hand vertical section 231 has been omitted from the drawing for clarity. It will be seen that the strip 235 passes directly between the two horizontal sections 229*a* and 229*b* and since the lead anodes are placed or attached to the crosspieces 229*a* and 229*b* with their flanges, not shown, faced away from the strip, the two anodes are also held equidistant from the strip surface. This is shown in more detail in FIG. 25, which is a side or transverse view of one of the hanger arrangements shown in FIG. 24. FIGS. 23 and 24 for clarity and simplicity, do not show the dielectric wiper blade of the invention extending downwardly and upwardly from the crosspieces 229*a* and 229*b*. However, as noted below, such dielectric wiper blades are shown in FIG. 25.

As indicated, FIG. 25 is a side view of the hanger or support 227 of FIGS. 24 showing the flanges 225*c* and 225*d* of the anodes 225*a* and 225*b* extending up and down the sides of the cross sections or cross pieces 229*a* and 229*b* which are in turn attached to the vertical hanger sections 231. Also shown are two elongated dielectric wiping blades 237 which have been designated as upper blade 237*a* and lower blade 237*b*. These two wiping blades 237*a* and 237*b* are held between the flanges 225*c* and 225*d* of the anode 225 and the horizontal supporting sections 229*a* and 229*b* by pins or bolts 239 as best shown in FIG. 26. As will be seen, each of the hangers or support pieces 227, either alone or adjacent to a cooperating hanger, serve to support two plating electrodes or anodes 225 through their flanges 225*c* and 225*d* plus one dielectric wiping blade 237 mounted between the flanges 225*c* or 225*d*. Preferably, the hanger or support will be provided with a U-shaped lower section, as shown in FIG. 27, which shows a vertical hanger or vertical support 231 having a bent lower portion 241 between which the horizontal sections 229*a* and 229*b* for adjacent electrode sections 225 may be mounted with an insulating block 243 mounted between them as a spacer or for insulating purposes. The flanges of the anodes in the construction shown can be mounted or held either on the inside or outside of the cross pieces for the hanger section for that particular anode section, or, alternatively, can be made integral with the hangers.

In FIG. 26, two separate hangers or support pieces 227 cooperate to support adjacent sections of sectionalized anodes. This provides a balanced structure with, as shown, each cross piece 229 of the hangers 227 having a flange of the anodes 225 passed upwardly along the inside of the cross piece 229 and directly contacting the top of the wiping blade 237 between the two flanges. Alternatively, the flanges of the anodes 225 may be turned up and secured to the outside of the cross pieces 229. However, this, in effect, slightly reduces the length of the anode section, which is undesirable. Only one hanger can also be used at each intersection and in this case it will be desirable to bring the flange of one anode section under the hanger and secure it to the opposite side, secure the wiping blade against this flange of the anode and secure the flange of the adjoining anode against the opposite side of the wiping blade, thus gaining maximum length of the anode sections, but a somewhat less secure mounting for the wiping blade, particularly when consumable electrodes are being used. In FIG. 26, the vertical portion 231*a* of the hangers 228 passing between the two crosspieces 229*a* and 229*b* are shown in dotted outline.

FIG. 28 shows a further embodiment of a flanged anode 245 in which one flange 245*b* of the two flanges 245*a* and 245*b* incorporates or is molded about a copper strip 247 which is or constitutes the horizontal portion of a supporting structure or hanger 251, the vertical sections 253 and 254 of which extend upwardly from the end to support the entire unit as shown in FIG. 28A. The vertical section 254 does not contain the copper conductor 247 which is contained in vertical section 253. It will be recognized that in this structure or embodiment, the hanger structure and flanged anodes are, in effect, integral with each other.

The embodiments of the invention shown in FIGS. 23 through 28 will be recognized to provide a very practical and effective embodiment or embodiments of the invention which are easily supported in position in an electroplating bath at the proper distances from a strip passing through the bath. Furthermore, as will be recognized, the dielectric spacing blades or wiping blades 237 effectively guide the strip 235 between the electrodes 225 or 245 and maintain the strip spaced at the correct distance from the electrodes. The fairly close spacing of the multiple wiper blades 237 along the length of the anodes effectively guides the strip between the electrodes 225 or 245 preventing deviation of the strip and damping out oscillations in such strip which might cause it to approach closely enough to the anodes 225 or 245 to strike, or otherwise induce, an arc between the anodes and the strip. However, because of the very thin structure of the wiper blades, such blades do not interfere significantly or at all with the coating of the strip either in the vicinity of the blade or even underneath the blade, while the flexibility or resilience of the blade prevents such blade from wearing, except rather slowly. The blades 237 moreover very effectively immediately dislodge bubbles of hydrogen from the cathodic film which tends to build up on the surface of the cathodic workpiece 235.

FIG. 29 is an oblique view of a preferred chevron-type flanged anode arrangement in which the hangers 247, as a whole, and including particularly the horizontal support section 249, take the chevron shape shown diagrammatically in FIGS. 14 and 15 previously described. A vertical support 251 is provided on one side of each one of the chevron-shaped hangers 247. Each perforated anode 259 has a shape essentially of a rather fat arrow having a pointed leading end 253 pointed in the direction from which the strip approaches and a rear end having a V-section 255 pointing likewise in the direction from which the strip approaches and open toward the direction in which the strip moves away from the anode. The direction of movement of the strip is indicated by arrow 252. Flanges 257 on the perforated anodes 259 serve to provide a structure by which the perforated anode sections are secured to the horizontal supports 249 of the hangers 247. Flexible resilient wiping blades 261 are held rigidly in place upon the crosspieces or horizontal supports 249 or against the flanges 257 to provide a light brushing action upon the surface of the strip in essentially the same arrangement as shown in FIGS. 23 through 25, except for the chevron or V-shape of both the perforated anode 259 and the horizontal support sections 249 of the hangers 247 and the wiping blades themselves 261. As explained previously, orifices 263 are provided in the perforated anode. It has been found that the wiping blades 261 having the chevron shape are particularly effective at sweeping the thin layer of electrolyte which is normally carried along with the strip 235 and removing or urging such electrolyte towards the sides of the strip allowing new electrolyte to flow in through the perforations 263 in the perforated anode 259. In this way, fresh electrolyte is at all times being fed to the surface of the strip. In addition, it has been found that the chevron or V-shaped wiping blades are particularly effective in preventing oscillations of the strip surface which might cause the strip to approach the closely spaced anode such that arcing between the anode and the cathodic strip surface may take place, damaging both structures. As may be seen in FIG. 29, for example, the leading section or point 253 of a following flanged anode may approach rather closely or even overlap an imaginary line connecting the ends of the V-section of an earlier or preceding anode in the direction in which the strip is passing so that the strip surface is supported against substantial oscillations, not only longitudinally, but also transversely of the strip. Stated otherwise, the strip may be stabilized by the following wiping blades 261 not only at spaced points transverse of the strip, but also at longitudinally and transversely displaced points extending over a substantial portion or area of the strip. See, in particular, FIG. 30 which is a plan view of one of the chevron-type perforated anodes 259. The flanges 257 are secured in any suitable manner to the horizontal portions 249 of the hangers 247, which horizontal or cross-support sections preferably continue or extend out from the side of the actual anodes at an angle providing further movement or agitation of the electrolytic liquid within the area of but extending to the side of the anode. As shown best in FIG. 30, the perforations 263 in the surface of the anode 259 preferably have an overlapping or staggered pattern. A very preferred staggered pattern may be referred to as a "bowling pin" hole pattern which is illustrated diagrammatically in FIG. 30A. As explained above, this overlapping pattern subjects any longitudinally moving portion of the strip to first an open or porous section of the anode and then to a solid section of the anode, then again to open or porous section, then to a solid section, and so forth such that no portion of the strip tends to remain under either a solid portion or open portion on the average more than any other section. This aids in preventing the development of transverse gradations of coating thickness across the finally coated strip surface forming longitudinal lines of differential coating thickness extending along the length of the strip. Two adjacent anode sections 259 are shown in FIG. 29. However, it will be understood that additional anode sections may be used on either end of the two illustrated sections.

A further embodiment of a chevron-type arrangement is shown in plane view in FIG. 31 in which a series of flanged chevron sections are bolted together as in previous embodiments or, as an alternative, may be otherwise secured together to form a unit. In FIG. 31, the leading chevron 265 is cut away in the center portion 265*a* so that a flow of electrolyte moving along with the strip passes through the center of the blade, under the flange with its adjacent blades and is directed against the second chevron 267, which is also provided with a cutaway section 267*a* in the center, but which cutaway section 267*a* is smaller than the cutaway section 265*a* in the first chevron 265. Again, the third chevron 269, is provided with a still smaller opening 269*a* in the center so that proportionately less of the electrolyte dragged along with the surface of the strip is directed to the sides and flows out of the sides between adjacent chevrons. The last chevron 273 in the group has no opening at all in the center so that all of the flow through the center of the other chevrons is directed to the sides in front of the chevron 273. As in the previous views, the orifices or perforations 263 in the surface of the anode itself, are staggered to prevent a continuous alignment of the orifices with the surface of the strip. The arrangement of the chevron wipers shown may provide a more vigorous flow of electrolyte over the surface of the strip and a better exchange of fluid with the surrounding electrolytic bath material. It will be understood that while the arrangement has been described as used with flanged anodes between which dielectric wiper blades may be held, that in fact, particularly since the chevrons are arranged in a particular order, holders or supports for the dielectric wiping blades may be fabricated as a unit with respect to the perforated portion of the flanged anodes such that a full anode section, which may even have a shape other than the triangular shape of the chevron hangers and wiper blades, is formed as a unit and may be mounted as a unit within the coating bath. However, it will also be understood that the most convenient construction is again to provide the chevron configuration or structure to the hangers plus flanges on the perforated anode sections and to have sections of wiping blades extended between the flanges on the anode sections and/or the lower portions of the hangers. In this manner, a very strong construction is formed when the various sections of the flanged anodes are bolted together. In FIG. 31 an arrow 272 indicates the direction of movement of the strip.

FIG. 31A is a diagrammatic illustration of design parameters for the open-ended chevron sections shown in FIG. 31 wherein it will be seen that a series of chevron-type constructions 274*a*, 274*b*, 274*c*, 274*d* and 274*e*, i.e. five in number, are set at about one-foot intervals over a nominal five-foot section of perforated anode with chevron support sections. Since the end of the sides of each chevron is preferably approximately positioned on the same line along the strip as the center of the following chevron, the total length of a section of five chevron wipers one foot about apart will be five feet in length. Other lengths may, of course, be used such as 10 total feet using 10 individual chevrons, particularly in large industrial installations and in such installations there may well be several separate units of the chevron-type installations. Other distances between the individual chevrons may also be used. As shown in diagrammatic FIG. 31A, the forward portion 274*aa* of the first chevron 274*a* is cut out to a maximum width of about one half the dimension of the distance between adjacent chevrons, or in the case illustrated, about one-half foot. From the sides of this cutout portion, two dotted lines 276*a* and 276*b* are projected rearwardly to the forward edge of the last chevron 274*e*, which is not cut out, and the intervening three chevrons 274*b*,274*c* and 274*d* have sections removed to a width which is encompassed between the dotted lines 276*a* and 276*b* which, as indicated above, are merely imaginary projections of a reversed triangle or triangular section 278. The triangle 278 is, therefore, an imaginary isosceles triangle having two sides 276*a* and 276*b* plus a base 276*c*, which define within them the proper openings in progressively less cut out adjacent chevron sections. The progressively narrower openings within the chevrons are very effective to create additional turbulence and flow of surface electrolyte within the chevron section or assembly, which may be referred to as a "chevron cell". It may be desirable to have the initial opening in the first chevron up to as much as the actual distance between chevron, or in for example a ten foot cell or unit of chevron wiping blades mounted upon a perforated anode construction at one foot intervals an initial opening up to one foot across.

FIG. 32 is a side view or elevation of an extended length of T-shaped resilient wiper blade in accordance with the invention, which, as will be explained, may be fed across an electrolytic coating line continuously or discontinuously as such wiper blade wears so that the electroplating line will not have to be stopped in case of wear of the various wiper blades to secure or mount new blades between the flanged sections of the anode. An end cross section of the T-blade is shown in FIG. 33 and a cross section of a flanged blade securing holder or T-section holder is shown in FIG. 34. In FIGS. 32 and 33, a T-shaped blade 275 is shown having an upper section 277 which constitutes the crosspiece of the "T" and a lower section 279 which constitutes the flexible blade itself. The crosspiece 277 provides a structural portion of the blade.

In FIG. 34, a combined holder and T-flange channel 281 is shown which takes the shape generally of the T-blade 275 itself with sufficient inner-dimensions to allow the T-blade to pass within and through it. The track or holder 281, like the T-blade itself, has an upper cross-T section 281*a* and lower section 281*b*.

FIG. 35 shows a series of T-blade holders or tracks 281 mounted between flanged anodes 283*a* and 283*b* at the top and the bottom of a strip 285, respectively. It will be seen that the three T-blades 275 have been slipped into upper and lower T-blade holders 281 from the side and such T-blade holders 281 have been used as flange supports to which the flanges 283*c* of the upper and lower flanged anodes 283*a* and 283*b* have been attached by any suitable securing arrangement. Such attachment may be by welding, brazing or other suitable securing means which is effective to provide a permanent attachment of the flanges to the T-section supports. It is not so important in this embodiment for the flanged anodes to be disassembled to allow new wiping blades to be inserted between the flanged anodes as in the previously illustrated embodiments. Consequently, permanent attachment of the flanges of the anodes can be made to the T-blade support means. However, where sufficient room is available, it may be more efficient to secure the flanges of the anodes to the T-blade holders by means of temporary securing means such as bolts or the like so that the entire construction may be disassembled, particularly where sacrificial anodes are being used which will eventually dissolve in the electrolytic bath and must be replaced. Suitable hangers, not shown, will be attached usually to the T-blade holders to support the anodes 283*a* and 283*b* plus the T-blades 275 and tracks 281. However, such hangers may also be attached directly to flanged anodes in any suitable manner.

Figure 36:
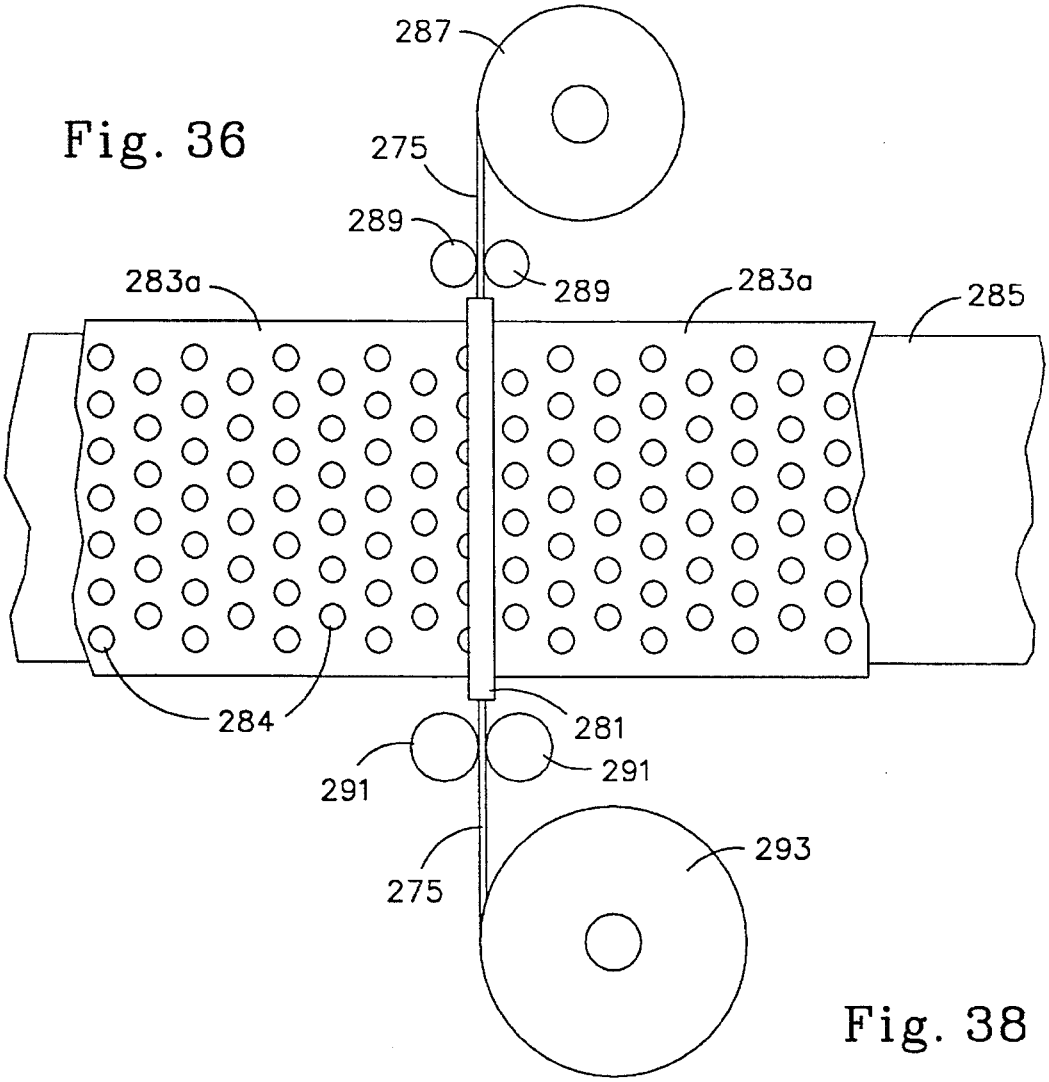
FIG. 36 is a partially sectioned diagrammatic top view of a T-shaped blade as shown in FIGS. 32 to 35 mounted on a continuous coating line with reel-to-reel feed.

FIG. 36 is a top, partially broken-away view of the T-section-type wiping blade 275 being fed at a controlled rate across the strip 285 in the holder 281 between adjoining perforated anodes 283*a*. It will be understood that a similar perforated anode 283*b*, not shown, will be directly below the upper anode 283*a*. The anodes 283*a* and 283*b* have perforations 284, preferably staggered or overlapping perforations as in the other illustrations. The coil 287 of T-strip which is able to coil into a fairly tight roll or coil due to the small size or transverse dimensions of the T-strip, is held in coil form on a reel and guided as it unwinds by the guide rolls 289, which are shown located at the entrance to the holder or track 281. The guide rolls 289 are positioned between the coil 287 and the T-section guide or T-blade holder 281 directly in line with the opening in the T-blade holder so that as powered drive rolls 291 are turned, the T-section is pulled into the end of the T-blade holder 281 where it is held loosely so that it can be passed through the holder and out the other side between two guide-drive rolls 291 also in line with the end of the T-blade holder 281. The drive rolls 291 feed the T-blade 275 onto a take-up reel 293 which may itself also be powered.

The T-blade holder 281 may be provided with resilient material, not shown, which may take the form of either a resilient plastic material or a series of spring-loaded guide plates, not shown, along the inside top of the T-blade holder 281 which bear against the upper flange 277 of the T-blade such that the T-blade is stabilized within the holder and bears against the strip 285 passing between the two perforated anodes 283*a* and 283*b*. As shown in FIGS. 33 and 35, the lower portion or principal blade portion 279 of the T-blade 275 is preferably flexed as in previous embodiments of the wiping blade against the strip 285 to provide a very light wiping pressure against the strip and also to stabilize the position of the strip between the two anodes. As will be understood, while the strip is only very lightly touched or "kissed" by the tips of the blades as the strip 285 passes between the flexed portion 279 of the blades 275, if the strip is displaced either up or down, it will immediately place additional pressure against the flexible or resilient blade 279 causing such blade to flex more strongly and place a higher pressure against the side of the strip, thus tending to force the strip back into the central position between the two blades. In this way, the strip is very effectively stabilized between the blades, even though the blades do not press upon the strip with any great pressure and the blades do not interfere with the coating of the strip from the electrolyte adjacent the surface of the strip. As explained previously, the wiping blade, which preferably contacts the strip only against one edge of the extreme end of the blade, causes small bubbles of hydrogen to detach from the surface of the strip while encouraging the cathodic layer or film to agglomerate into other small bubbles which will be dislodged from the strip by the next blade, or even possibly after several blades have passed across that section of the strip. The pressure of the wiping blade upon the strip surface is also sufficient to prevent the thin barrier layer of electrolytic liquid or solution, which tends to be drawn along through the bath with the movement of the strip itself and which becomes quickly depleted of coating material, if not removed, from passing the wiping blade and to wipe said thin barrier layer to the side or force it upwardly through the perforations in the anode while fresh solution is drawn into contact with the strip behind the wiping blade.

Figure 37:
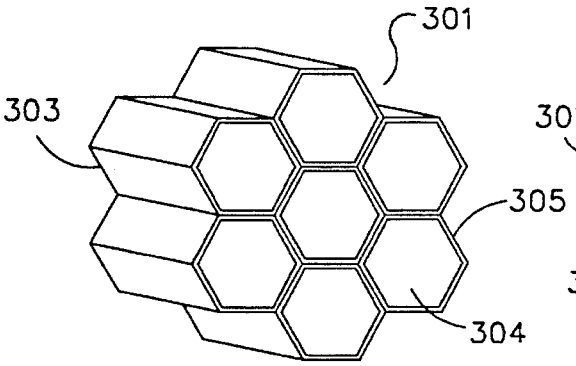
FIG. 37 is an isometric view of a portion of a less preferred alternative type of wiping blade.

FIG. 37 is a diagrammatic isometric view of an alternative less preferred form of wiping blade 301, referred to generally as a honeycomb-type wiping blade. Such honeycomb-type wiping blade 301, as shown, comprises a series of plastic hexagonal membranes which form a series of interlocking walls or blades having generalized outer and inner ends 303 and 305. Such two ends or sides may be referred to as outside and inside. Conventionally, the inside will be considered to be the wiping side and the outside to be the external side away from the strip. The openings through the honeycombs are designated as 304 and serve as passageways for hydrogen bubbles and spent electrolyte to pass through the honeycomb.

Figure 38:
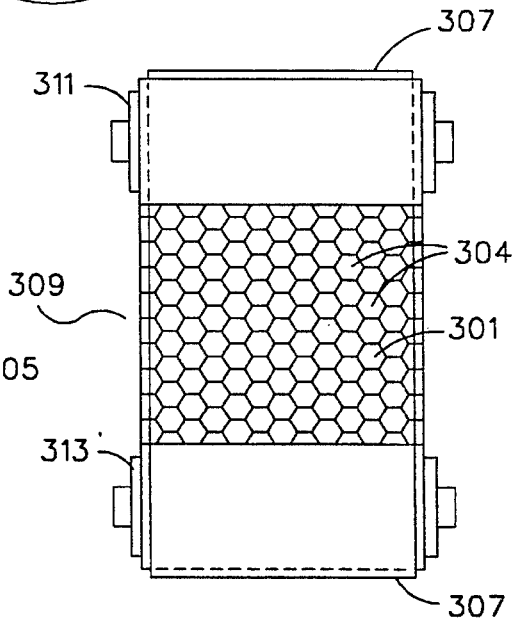
FIG. 38 is a diagrammatic transverse view of a coating line using an alternative wiping blade such as partially shown in FIG. 37.
Figure 39:
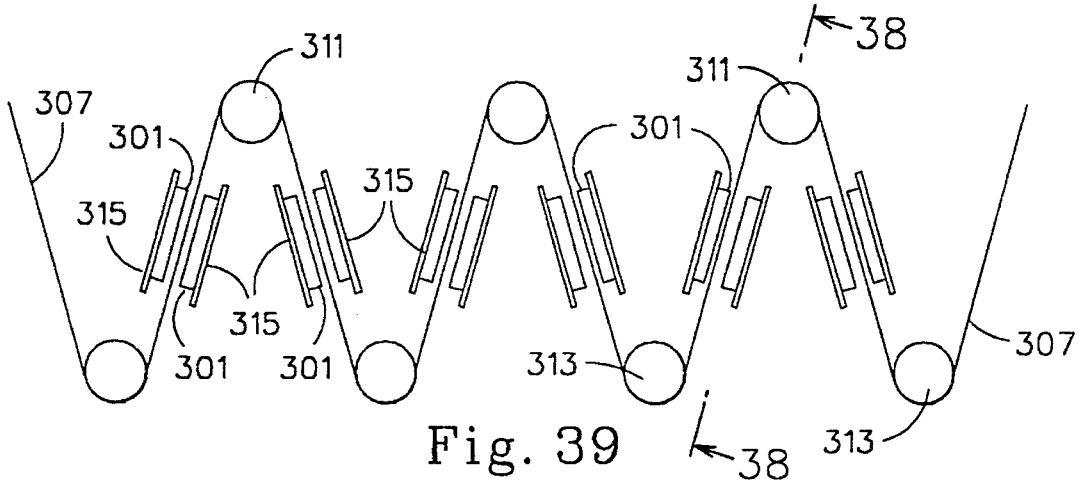
FIG. 39 is a diagrammatic longitudinal elevation of the alternative type of wiping blade shown in FIGS. 37 and 38 mounted or in use on a coating line.

An assembly of honeycomb-type wiping blades 301 are shown mounted adjacent alternating upward and downward runs or legs 309 of the strip 307 in FIGS. 38 and 39. FIG. 38 is an enlarged section taken along line 38—38 in FIG. 39, but additionally showing the guide rolls at the end of the leg of the strip. The upward and downward legs of the strip 307 are maintained in place by a series of upper guide rolls 311 and lower guide rolls 313. These guide rolls 311 and 313 effectively direct or turn the strip 307 within a coating tank, not shown, into a more or less vertical runs which are shown slightly slanted in FIG. 39, which as indicated is a diagrammatic illustration of the same overall coating line assembly, but, it will be understood, could be completely vertical in orientation and arranged such that the honeycomb wiping blades 301 when placed against the sides of the strips are oriented in such a position that when bubbles of hydrogen are wiped from the surface of the strip, such bubbles and depleted electrolyte can pass through the openings 304 and the honeycomb structure as a whole and escape into the coating bath where they float upwardly to the surface of the bath, not shown. In the embodiment of the invention shown in FIGS. 38 and 39, each of the honeycomb sections 301 are in fixed position, close to the sides of the strip and as the strip passes upwardly, it will tend, by shifting from side to side, to contact first one section of the honeycomb on one side and then another section of the other honeycomb on the other side. In this manner, the strip is continuously being wiped in some sector of the strip against one of the honeycombs and in most cases will be continuously wiped at several sectors between each honeycomb as it deviates from side to side. While this arrangement is not as satisfactory as having actually flexed blades continuously biased or resiliently forced into the side of the strip at all times, it does serve to prevent the strip from touching the electrodes 315 which are positioned outboard of each of the honeycomb sections 301. In this way, arcing between the strip and the anodes is prevented and the surface of the strip is continuously wiped to remove bubbles of hydrogen and depleted electrolyte which thereby activates the cathodic layer to cause the formation of new bubbles which then float upwardly in the bath. A fairly effective continuous wiping of the surface of the strip is thereby effected. In FIG. 38, the outer of two honeycomb wipers 301 is shown with the strip 307 passing under such honeycomb wiper and the outer perforated anode removed or not visible. It should be understood that a further honeycomb wiper not shown is under the strip 307. In other words, the view in FIG. 38 is, as indicated above, of the assembly taken along section 38—38 in FIG. 39 described hereinafter.

FIG. 39 shows the honeycomb section 301 in a partially broken-away side view of one of the legs or runs of the strip 307 about the guide rolls 311 and 313. It will be seen with reference to FIGS. 38 and 39 that the honeycomb section extends completely across the surface of the strip 307 and on a statistical basis, continuously wipes the strip in the various consecutive sectors of each run or up and down leg so that after the strip gets through a series of runs, it has been rather thoroughly wiped at various places as it passes between the honeycomb sections.

Figure 40:
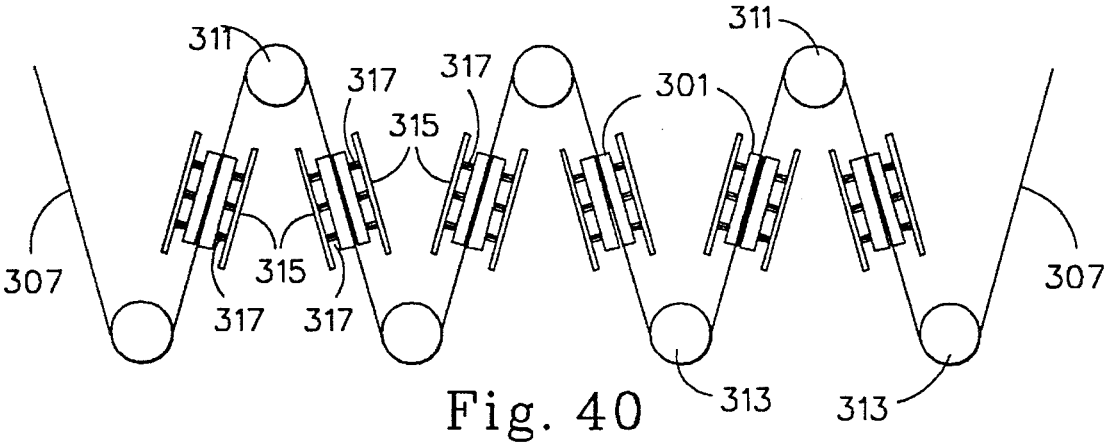
FIG. 40 is a diagrammatic side or longitudinal view of an improved embodiment of the invention shown in FIGS. 37 and 39.

FIG. 40 is a further side illustration of an embodiment of the invention in which honeycomb sections 301 are provided along the vertical or angled runs of a strip 307 being passed over the upper guide rolls 311 and lower guide rolls 313 as in FIG. 39. In FIG. 40, however, the honeycomb sections are resiliently mounted against the bottom of perforated anode sections 315 by resilient means 317 which may take the form of a resilient plastic construction or in some cases, polymeric spring-type structures which are resistant to the electrolytic coating bath. The arrangement shown in FIG. 40 will be recognized to provide a more positive wiping action of the honeycomb sections upon the surface of the strip 307, but also to provide a more complicated arrangement having in addition, increased likelihood of actual failure of the resilient means to keep the honeycomb sections positioned against the strip surface. However, it will be recognized that even if the resilient means should fail, the honeycomb sections are still held in position essentially in the same positioning as shown in FIG. 39 where such honeycomb sections are in permanent placement adjacent to the strip. Consequently, even if the resilient means 317 in FIG. 40 should fail, the arrangement will still remain operative.

It will be recognized that the honeycomb arrangement for wiping blades with its possible wiping action, may be offset by the detriment of greater wear, if the honeycomb sections are actually forced against the side of the strip surface. However, because such strip surface tends to have a greater wearing effect upon the relatively solid structure of the honeycomb sections, rather than dissipating the force by the actual resiliency of a flexed blade or a thin flexed blade as shown in previous figures, there may be limited disadvantages in the arrangement shown in FIG. 40. However, to some extent the multiple walls of the honeycomb construction provides more polymeric material to wear so that the life of such wiper may not be actually that much diminished from the wear which is experienced by flexed blades.

Figure 41:
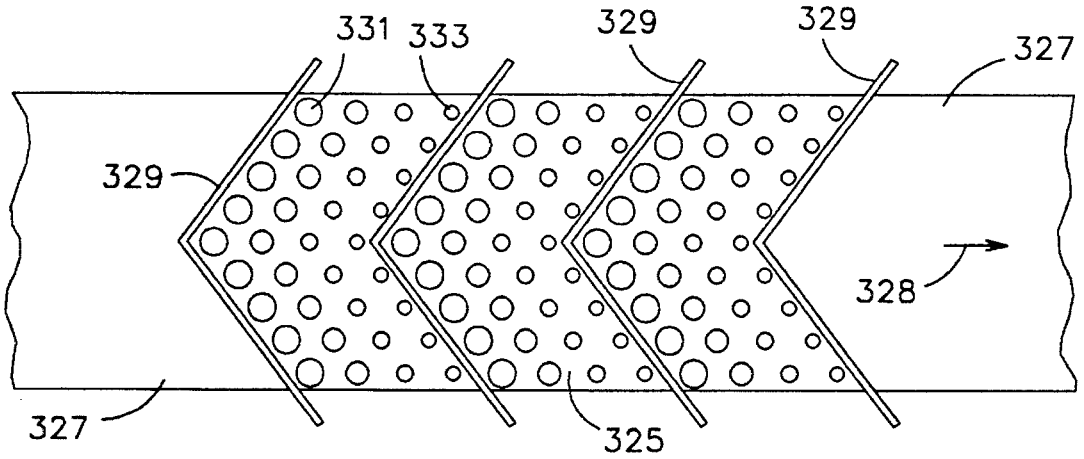
FIGS. 41 is a diagrammatic plan view of an improved embodiment of the invention, shown in FIGS. 29 and 30.

FIG. 41 is a diagrammatic illustration of an embodiment of the invention using chevron-type wipers in which orifices 331 in the perforated electrode 325 located at the rear end of the chevrons 329 are larger than orifices 333 located near the front of the adjoining chevrons. This allows more electrolytic solution from the open portion of the plating tank to be fed through the openings in the perforated anode 325 directly behind the chevron wiping blades 329, where cavitation may otherwise prove to be a problem, than through the orifices at the beginning of or adjacent to the next chevron configured blade 329 where it is hoped that the electrolytic solution will be forced mostly from the sides of the chevrons in any event rather than up through the openings in the perforated anode 325 within the space between consecutive chevrons. Since a fast moving strip 327 moving in the direction indicated by the arrow 328 may otherwise carry a considerable barrier layer of electrolytic solution along with its surface, absent the wiping blades, and particularly the chevron-type wiping blades 329, such blades may force substantially all of such electrolytic liquid from the space or volume between the blades. Thus, cavitation may become a problem directly behind the triangles or triangular configuration of the wiping blades. However, such cavitation can be alleviated by placing larger openings in the perforated anode directly behind the wiping blade to facilitate flow of electrolytic fluid through this portion of the anode and smaller openings in the perforated anode directly in front of the following wiping blade to somewhat restrict flow of solution from some such openings within the anode and force most of the fluid out the sides between the strip and the anode while encouraging flow of electrolytic solution through the larger orifices behind the chevron sections. In this manner, fresh electrolytic solution is maintained across the surface of the strip at all times within the area encompassed by the wiping blades so that efficient plating may also take place across the surface of the strip at all times.

FIG. 42 is a top diagrammatic view of an arrangement of the invention in which the sides of a chevron wiping blade arrangement are closed in by walls 324*a*, 324*b* and 324*c* plus a top and bottom, not shown on both sides and a pump, shown as a centrifugal pump or pumps 323, are attached to the closed-in sections so that not only is the spent electrolytic solution encompassed within the barrier layer drawn along with the surface of the strip 327 discharged from the side of the chevron arrangement by the wiping effect of the resilient dielectric blades upon the surface of the strip, but the material or electrolytic solution between the perforated electrodes or anodes 325 and the surface of the strip 327 is actually drawn away from the sides of the chevron sections by the fluid current in the electrolytic solution generated by the suction of the centrifugal pumps 323 and such solution drawn away from the ends of the chevrons 329 is then deposited within the body of the electrolytic coating tank, not shown, in which the entire arrangement is submerged, or alternatively discharged to a suitable heat exchanger back to the "mother" solution handling and feeding tank, also not shown, where solution temperature and solution concentration are tightly controlled to assure proper plating conditions, meanwhile allowing fresh solution from the body of the coating tank, to be drawn into the orifices 331 of the perforated electrodes 325.

FIG. 43 is a further diagrammatic view of an electrolytic coating line showing chevron-type wiping blades similar to the arrangement shown in FIGS. 41, and 42 but wherein the centrifugal pumps 323 rather than being attached to an open collection main superimposed over the ends of the chevron wiping blades, i.e. within the volume encompassed by the walls 324*a*, 324*b* and 324*c* in FIG. 42, are instead attached to a multiple manifold arrangement. A series of separate manifolds 335, 337 and 339 disposed on both sides of the line, extend up to or slightly between the chevron wiping blades 329, essentially right up to the edge of the strip 327 and the perforated anodes 325 respectively on the top and below the strip 327. Electrolytic solution is drawn by the manifolds 335, 337 and 339 from between the upper and lower strip surface and the upper and lower perforated anodes 325 while the thin depletion layer, or barrier layer, of depleted electrolytic solution and hydrogen bubbles are, in effect, ploughed from the surface of the strip by the resilient wiper blades and urged outwardly by the wiper blades as fresh electrolytic solution from the main body of plating solution passes or is drawn through the orifices 331 and 333 in the perforated anodes 325 to replace the electrolytic solution directed to the sides by the wiper blades and actively drawn away from the sides into the manifolds 335, 337 and 339. The electrolytic solution passes from the separate manifolds 335, 337 and 339 into common header 326 through which it is drawn to the centrifugal pumps 323. The arrangement shown in FIG. 43 is somewhat more complicated than that shown in FIG. 42, but provides a more positive force, or actually negative force, tending to draw all electrolytic solution, including solution from the depleted surface layer, or barrier layer, plus the hydrogen bubbles, from between the chevron-shaped blades. This provides further assurance that the electrolytic solution is rapidly and regularly changed or replaced, preventing the development of any significant depletion or depleted layer of electrolytic solution adjacent the surface of the strip being electroplated. The orifices in the perforated anode 325 in FIG. 43 are, as in FIGS. 41 and 42, larger behind the chevron wiper sections 329 and smaller along the front of the chevron sections to counteract possible cavitation due to inability of the space between the strip and the perforated anode 325 to fill as quickly as the liquid is swept or displaced from behind the chevron-shaped wiper blades. The larger anode orifices are designated by the reference numerals 331, while the smaller are designated as 333.

FIG. 44 shows the use of a T-section-type wiper blade used against the strip surface of a strip 327 in a modified chevron arrangement. As explained above in connection with FIGS. 32 through 35, the use of a T-shaped wiper blade has certain advantages, the principal one being that it can be used in long lengths and moved progressively, either continuously or discontinuously, across the strip surface as the blade wears so that a fresh blade surface, or at least not a worn down or damaged blade, is presented to the metal substrate or strip surface at all times.

The use of a chevron-shaped wiper blade is also advantageous as the construction not only does a very efficient job of directing both any debris detached from the surface of the strip to the sides, but also of sweeping out to the sides depleted electrolytic solution plus hydrogen bubbles that are removed by the wiping blade from the surface of the strip while fresh electrolytic solution flows into the area between the strip and the anode through perforations in the anode. In the usual chevron wiper arrangement, the wiper blade sections in the two halves of the chevron are comprised of two separate blades even when the two blades as a unit extend entirely across the strip. This allows such blades to readily flex, which flexing is quite important to prevent the blades from wearing severely and also to provide the most effective wiping of the strip surface. If the wiping blade was, on the other hand, a solid bent blade, the shape of the blade would cause it to become essentially inflexible at and in the vicinity of the intersection of the two sections of the blade causing this section and adjoining sections to rapidly wear and interfering with the efficiency of wiping. In view of this relationship between continuous blades and a chevron configuration, it is not practical to have a continuously renewable blade such as shown in FIGS. 32 through 36 with a strict chevron-shaped blade. However, the present inventors have developed a modified chevron configuration in which the center of the blade configuration is curved rather than intersecting at a definite angle. Such a curved configuration at the apex of the blade is shown in FIG. 44 described in further detail below.

In addition to being arranged in curved configuration, the lower portion of the blade itself is slit at intervals as shown in FIG. 45. This allows the flexing portion of the blade to flex independently of adjoining portions of the blade. In FIG. 45 the upper crosspiece of the T-section is designated as 277, as before, and the lower wiping section is designated as 279*a*, while the separate elements between slits 278 in the blade are designated as 279*b*. Such slits enable the lower portion of the blade 279*a* to flex easily, even though the blade is bent transversely. Preferably, the slits in the lower blade 279*a* are indexed at predetermined distances so that when a new section of blade is moved into position, the portion extending over or under the strip has a slit more or less exactly in the center. This allows sufficient resilience or flexibility of the blade to prevent severe wear and to effectively wipe the surface of the strip. This is shown diagrammatically in FIG. 46 where a T-shaped blade 276 without the accompanying or guiding track or guide is shown with a top or crosspiece 277 and the bottom flexible blade 279*a* with indexed slits 278 between discrete blade portions 279*b*. This entire blade is shown bent or curved into the shape it would assume within a blade holder designated for retention between two flanges of adjacent perforated anodes, not shown. At the ends of the blade 276 are two capstans or reels 341 and 343, the first of which is a payoff reel and the second of which is a capstan for drawing the blade off the payoff real. This arrangement is shown from above in FIG. 44 where a series of four payoff reels 341 are disposed next to four blade holders or guides 345 which extend across the strip similar to the blade holder 281 shown in FIGS. 34 and 35. Paired guide rolls 347 are disposed at the entrance to the holders or guides 345 to guide T-section blades into the holders and the blades extend from the bottom of the holders 345 essentially as shown in FIG. 35 to bear against the strip surface. At the opposite ends of the blade holders or guides 345 are four capstans 343 again with paired guide rollers 349 between the capstan and the end of the blade holders 345. As the capstans 343 rotate, the flexible blades 276 are drawn onto the capstans 343. As in FIGS. 42 and 43, the orifices in the perforated anodes are larger behind the blades and holders, i.e. in the curve provided, and smaller in front of the curve of each to counteract possible cavitation behind the blades.

FIGS. 47, 48 and 49 show in three separate but related figures, embodiments of the blade holders 345 in which FIG. 47 shows a T-shape blade holder with a blade encompassed therein similar to the blade holder shown in FIG. 34 without the blade. FIG. 48 shows a cross section of a variation of a T-section blade which is more in the form of an abbreviated cross with an enlarged cross bar together with the holder for such section. The arms of the cross are designated as 353, while the upper portion is designated as 355. The holder 357 has a conforming shape. FIG. 49 shows a cross section of a still further alternative embodiment of a blade section having the configuration essentially of a double cross or double crosspiece telephone pole in which the two arms are designated as 359 and 361. The holder 363 has a single central expansion on both sides in the center of which are two guide vanes 367 which serve to guide or stabilize the elongated blade as it is passed through the holder 363.

The arrangements shown in FIGS. 32 through 35 and in FIGS. 44 through 49 are desirable, but relatively more costly designs in which the flexible wiping blades of the invention can be continuously or intermittently changed or renewed as the blade wears without stopping or interfering with the plating line operation. In arrangements such as shown in FIGS. 19 through 27, on the other hand, the basic hanger and electrode arrangement may make it relatively inconvenient to change the wiping blades of the invention or to rethread a new strip between the blades. A cheaper but relatively less sophisticated arrangement for changing blades and rethreading strip through the line using the basic hanger system shown in FIGS. 19 through 27 is shown in FIGS. 50 through 55 in several alternative embodiments.

Figure 50:
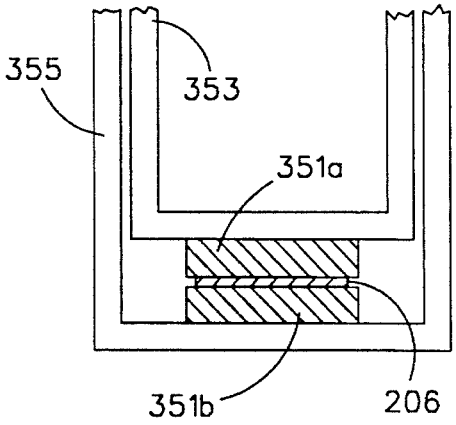
FIG. 50 is a diagrammatic transverse cross section of an arrangement for removing wiping blade anode assemblies shown in FIGS. 23, 25 and 26 from the strip by movement of the hangers in order to thread the strip through the line or replace the wiper blades.
Figure 51:
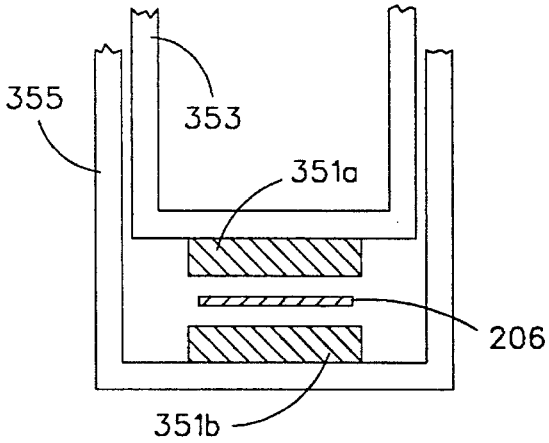
FIG. 51 is a diagrammatic view similar to FIG. 50 showing the hangers and wiping blade anode assemblies in open position.

FIGS. 50 through 55 show diagrammatically alternative arrangements for removing the anodes and flexible wiping blades conveniently from adjacent the surface of the strip both to allow the strip to be conveniently threaded through the otherwise closely spaced wiper blades and perforated anodes and to replace the wiper blades themselves when replacement becomes necessary. In FIGS. 50 and 51 there are shown transverse, or down the line, views of wiping blade anode assemblies 351*a* and 351*b* as previously disclosed mounted upon adjacent hangers 353 and 355, which may be independently raised, in the case of hangers 353, and lowered, in the case of hangers 355, as shown in FIG. 51 to open a distance between the wiping blade anode assemblies 351*a* and 351*b* on both sides of the strip 206. The flexible wiper blade and strip are shown diagrammatically in cross section. It will be understood that the hangers 353 and 355 may be supported above the plating tank in any suitable manner, not shown, and can be vertically moved independently in various ways, including manually or by any suitable power and control system, also not shown, when necessary. The hangers 353 and 355 may be separate as shown with the hangers 355 for the lower wiper-anode assembly outwardly displaced with respect to the hangers 353 for support of the upper wiper-anode assembly. Alternatively, the hangers may be slideably interengaged with each other allowing independent up and down movement to displace the wiper-anode assemblies away from the surface of the strip 296 when necessary as shown in FIG. 51.

Figure 52:
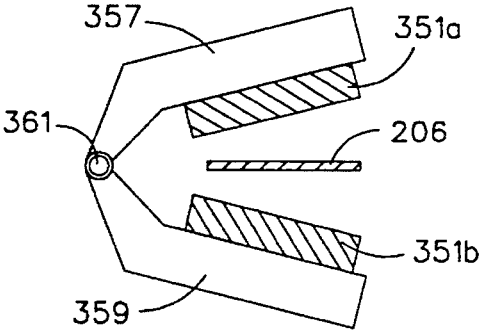
FIG. 52 is a diagrammatic transverse view of an alternative embodiment for opening wiping blade anode assemblies.
Figure 53:
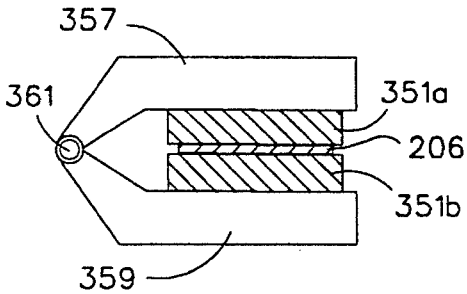
FIG. 53 is a diagrammatic transverse view of the arrangement in FIG. 52 in closed position.

In FIGS. 52 and 53 there is shown an alternative embodiment of a support arrangement for upper and lower wiper-anode assemblies 351*a* and 351*b* in which such assemblies are supported upon scissors-type arms 357 and 359 which may be rotated about an axis 361 by any suitable mechanical means such as interengaged gearing to open the wiper-anode assemblies away from the strip 206 as shown in FIG. 52 or position them against the strip as shown in FIG. 53.

The arrangement shown in FIGS. 52 and 53 is very effective in moving the wiper-anode assemblies 351*a* and 351*b* away from and toward or against the strip 206.

Figure 54:
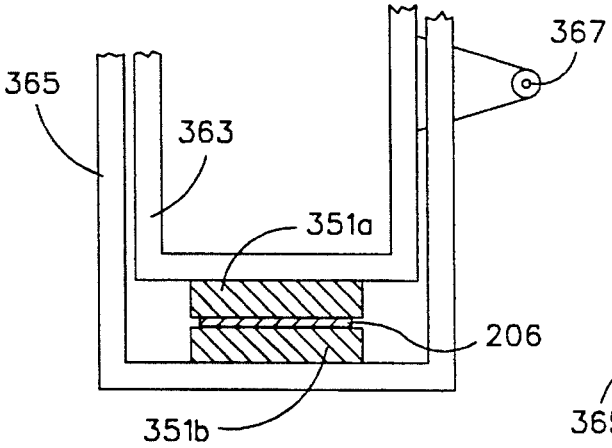
FIG. 54 is a diagrammatic transverse view of a further alternative embodiment of openable wiping blade anode assemblies.
Figure 55:
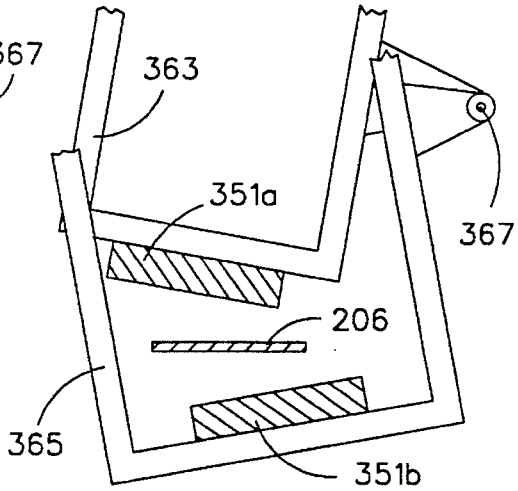
FIG. 55 is a diagrammatic transverse view of the embodiment of FIG. 54 in open position.

However, it has the disadvantage of having its working or movable interengaging parts exposed to the electrolytic solution. In FIGS. 54 and 55 there is shown a third embodiment of the invention which avoids this disadvantage by pivoting two more conventional hangers 363 and 365 near the top as shown in FIG. 54 at pivot point 367 allowing such hangers to be pivoted in opposite directions to swing their lower portions away from the strip 206 as shown in FIG. 55. The hangers 363 and 365 are displaced from each other not only transversely as viewed in FIGS. 54 and 55, but also longitudinally with respect to each other, i.e. at right angles to the plane of the paper as viewed in FIGS. 54 and 55. Alternatively, the hangers could be merely displaced longitudinally with a slight extension of the lower portion of the hangers to bring the wiping blades, in particular, into their preferable opposed positions, although it is also possible to have the wiping blades displaced from each other along the strip. However, it is preferable for the wiper blades and the anodes to be substantially opposed to each other in order to maximize the guiding or stabilizing effect of the dielectric flexible blades upon the strip as well as to increase the uniformity of application of the electrolytic coating. By having an offset pivot 367 located above the surface of the electroplating bath, the hangers 363 and 365 can be conveniently swung to either side to remove the wiper anode assemblies from the surface of the strip or sheet in order to allow the strip to be threaded through the apparatus or to replace worn flexible wiper blades.

Figure 56A:
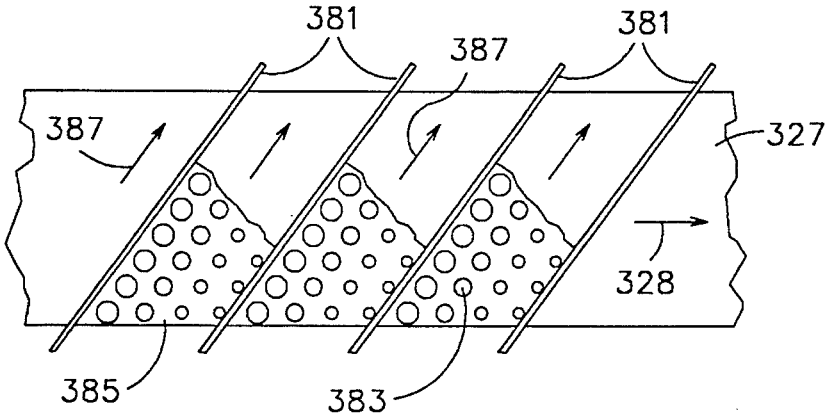
FIG. 56A, 56B and 56C are diagrammatic plan views of alternative arrangements of straight wiping blade assemblies angularly extended across a moving strip.
Figure 56B:
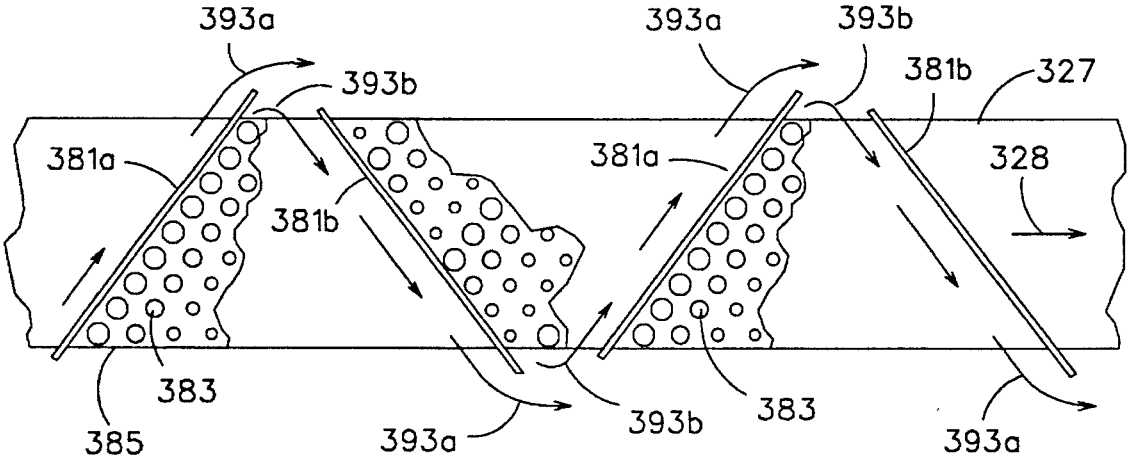
Figure 56C:
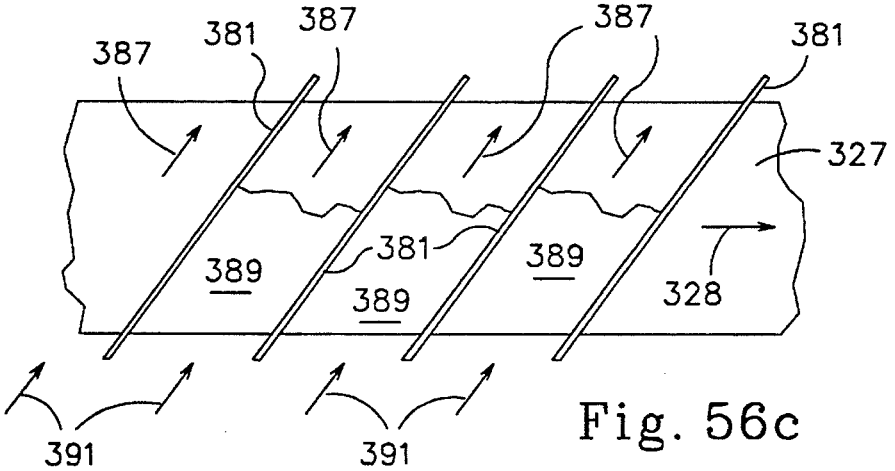
Figure 57:
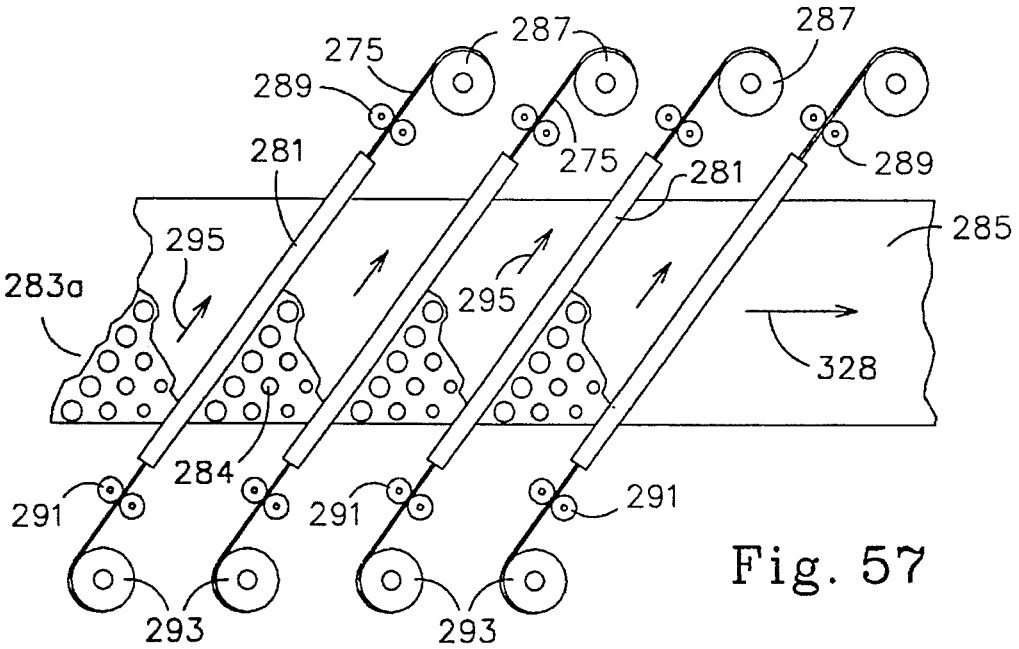
FIG. 57 is a diagrammatic plan view of an assembly of replenishable T-blade-type wiping blades extending angularly across a moving strip.
Figure 58:
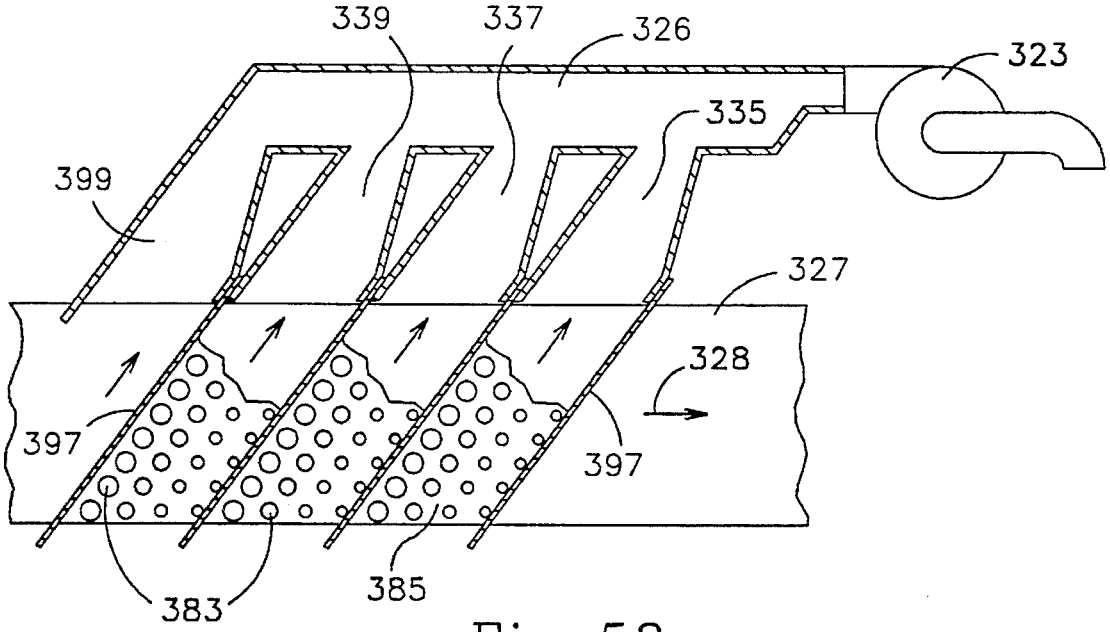
FIG. 58 is a diagrammatic plan view of an arrangement of angled wiping blades extending across a moving strip with a solution exhaust pump arrangement on the downstream side.

In FIGS. 56, 57 and 58 there are illustrated still further arrangements of the resilient wiper blades of the invention in which the blades, instead of being positioned at right angles with respect to the movement of the strip, are instead extended at an angle across the strip or cathodic workpiece. Such arrangement has the advantage of encouraging a liquid electrolyte or fluid current to flow across the strip or cathodic workpiece, which fluid current can be made to flow in any direction depending upon the angle across the strip assumed by the wiping blade. The arrangement is thus similar to the chevron-type wipers shown in previous figures, see for example, FIGS. 14, 29, 41, 42 and 43, except the flow created is directed to one side only rather than toward both sides of the strip. Liquid flow toward only one side has several significant advantages over splitting the fluid flow and directing such flow toward both sides of the strip as shown in previous figures. Having a more or less uniformly angled blade extending across the strip has the significant advantage, first, of creating a stronger fluid current or flow overall, which increased fluid flow more vigorously removes the electrolytic solution from in front of the wiping blades and sweeps it to the side. Secondly, the advantage of an angled blade is also attained without the principal disadvantage of a chevron-type blade arrangement, which may require a split in the center of the blade to allow the requisite flexibility or resilience of said blade.

In FIG. 56A, 56B and 56C, three possible arrangements of substantially straight, but angled, wiping blades are shown. In the first of these shown in FIG. 56A, a series of resilient wiper blades 381 are shown diagrammatically angled across the strip 327 which moves in the direction indicated by the arrow 328. A series of perforations 383 are provided in perforated anodes 385 which bridge the area between the wiping blades. Such perforated anodes are shown partially broken away to reveal the underlying surface of the strip 327 as well as arrows 387 which indicate the fluid current established in the electrolytic fluid between the perforated anodes 385 and the surface of the strip 327. In fact, with the vigorous fluid current established along the face of the strip by the angled blades, perforations in the anode may not even be necessary, as shown in FIG. 56C where, the same series of angled resilient wiping blades 381 are shown, but have associated with them a series of unperforated anodes 389.

It will be understood that in eliminating the perforations in the anodes, as shown in FIG. 56C, the required anode-to-cathode ratio for the best plating using a particular electrolyte will be maintained by the use of indentations, corrugation or other surface area increasing configurations upon the surface of the anode. This expedient is necessary, because, the perforations when used, will be configured and sized so that in combination with the relative thickness of the anode, the overall surface area of the anode compared to the cathodic work surface will usually be increased to meet the particular anode-to-cathode ratio best suited for the particular electrolyte and other coating parameters necessary in the particular coating operation involved. See, for example, FIGS. 2, 5A, 5B and 7, which illustrate diagrammatically a typical dimensional arrangement of an anode having an electrolytically active surface area greater than one. It will be recognized that the other figures herein showing anodes are generally diagrammatic only to illustrate the relative disposition of the anodes and wiping blades with respect to each other and not the relative configurations of the openings in the anodes or the configuration of the total active surface of the anodes. Conventionally, the anode surface is frequently grooved to increase its relative surface area. Combinations of grooves or other surface increasing expedients plus particularly shaped orifices may be used.

The anodes 389 in FIG. 56C are also partially broken away in their top portions to reveal arrows 387 which indicate the direction of flow of current established between the surface of the anode and the surface of the moving strip, between which surfaces the electrolytic solution flows toward the section of the strip shown at the top. The flow of the current is all in one direction, as shown at the top of the figure by the arrows 387 where the anodes 389 have, as indicated, been partially broken away. Likewise, the flow into the space between the anodes 389 and the surface of the strip is completely from one side, as shown by arrows 391. Such flow from the side is usually sufficient to completely flush away depleted electrolytic solution which is physically forced away from the strip surface by the resilient wiper blades and is immediately caught up and mixed with the flow of electrolytic solution flowing through the space between the anode and strip surfaces and thoroughly flushed from between the strip surface and the electrode by the fluid current induced. Such depleted solution is then replaced by fresh solution flowing in from the opposite side of the strip.

FIG. 56B shows an alternative arrangement of slanted or angled wiper blades in which alternate blades are angled in opposite directions, or at opposite angles. In this arrangement, the liquid flow is first across the moving strip from one side and then across the strip from the other side. This arrangement provides a more even mixing in the bath on both sides, but has the drawback of inducing a flow into the small end of the space between two angled wiper blades and out of the larger end resulting in a definite tendency to have a progressively lessening flow across the strip, somewhat counterbalanced by the use of perforations in the anodes. In FIG. 56B, there are shown a series of four angled wiper blades 381*a* and 381*b*, the blades 381*a* being inclined downstream of the moving strip to the left as viewed from above and the blades 381*b* being inclined downstream to the right. Both sets of blades 381*a* and 381*b* have their trailing ends extended farther to the side of the strip than the leading ends of the adjacent blades. This serves to at least partially direct the current of electrolyte solution about the longer trailing end of the resilient wiper blades in a transversely displaced path such that it more or less completely bypasses the adjacent leading end of the next adjacent wiper blade as shown by the arrows 393*a*. The flow along the adjacent wiper blade therefore tends to be derived from above and below the strip, as shown by the rear curved portion of the arrows 393*b*. Perforated anodes 385 in FIG. 56B allow additional electrolytic solution to be drawn in through orifices 383 in the anodes from the top and bottom areas of the bath next to the strip to compensate for the gradually increasing size of the opening between the wiper blades and to secure a more constant flow across the strip surface which aids in flushing away the depleted electrolytic solution physically scraped or diverted by the wiping blades 381*a* and 381*b* from the depletion layer next to the strip and normally carried along with the strip surface.

In FIG. 57 there are shown a series of slanted or angled replaceable wiper blades such as shown in FIGS. 32 and 36, the difference from the previous figures being that the blade is drawn across the strip surface at an acute angle, as shown in FIG. 57, rather than at a right angle to the strip, as shown in FIG. 36. This has the advantage over the arrangement shown in FIGS. 44 and 46 that the continuous wiping blade does not need to be slit to maintain its flexibility or resilience in the vicinity of the intersection of the chevron-shaped blade or in the arcuate section of a generally chevron shaped blade having a curved apex, thus eliminating any leakage through the slits, or discontinuities, in the blades, while still maintaining a snowplow-like action on the surface of the strip. Such snowplow-like action aids in establishing a transverse movement of electrolytic solution across the strip, thus aiding in flushing away the depleted electrolytic solution removed from adjacent the surface of the moving strip by the action of the resilient wiping blade. The various parts shown in FIG. 57 use the same reference numerals as in FIG. 36 in which the continuous resilient wiper blade 275 passes from a reel 287, between a pair of guide rolls 289 and into a blade holder or retainer guide 281 mounted preferably between perforated top anodes 283*a* and bottom anodes 283*b*, not shown, anodes 283*a* being partially broken away to reveal arrows 295 indicating the general flow of electrolytic solution between perforated anode 283*a* and the surface of the strip 285. Each of the anodes 283*a* and 283*b* are provided with perforation or orifices 284, which are shown as differentially sized orifices such as disclosed in FIG. 41. Such differentially sized perforations may be advantageous because the movement of the strip tends to urge the electrolytic solution more toward the downstream wiper blade. However, more or less uniform sized orifices can also be used. From the holder or retainer guide 281, the continuous flexible blade 275 passes between two further guide rolls 291 and then onto a reel 293.

While the angle of the wiper blades 275, for convenience, are shown in FIG. 57, as well as in FIGS. 56 and 58, as being approximately 45 degrees with respect to the strip in the direction of movement of the strip, the greater the angle the faster the flow induced across the strip. An angle of approximately 45 degrees will usually be found very satisfactory to obtain an effective flow. The actual preferred angle is that angle which will result in sufficient flow to quickly flush out or away from the vicinity of the wiping blades all depleted electrolyte and hydrogen bubbles which might otherwise tend to slow down plating action. It may be undesirable to have too acute an angle between the strip and the wiping blade because the depleted electrolytic solution, although rapidly diluted with flowing electrolytic solution, is maintained longer on or between the strip and electrode surfaces. However, a fairly steep angle of the blade with the strip is usually desirable.

FIG. 58 shows a still further embodiment of angled resilient wiper blades in which the flow of the electrolytic solution in one direction toward one side of the strip is taken advantage of by using a forced solution removal pumping arrangement such as shown in FIG. 43, for example, but only on the one side of the strip. Thus, by angling the wiping blades across the strip as shown, only as little as one half the capital cost for a pumping system may be required. Merely taking the same amount of electrolytic solution from one side of a strip as taken in the original arrangement would not ordinarily cut capital expenditure by a major amount, since the same pump volume and power might still be required, even though handled in a more restricted area. However, it must be recognized that angling the resilient wiping blade more efficiently converts the movement of the strip itself into energy available to create a movement of electrolytic solution more efficiently to one side and thus, in effect, decrease the energy input required for the pump to remove, or draw the same volume of solution into the pumping system. Thus the simpler exhaust or pumping system saves energy and capital cost overall. In FIG. 58 the straight angled wiper blades are indicated by reference numerals 397, while the partially broken-away perforated anodes 385 allow additional flow of electrolytic solution from the top and bottom. As in FIG. 56C, the anodes could, if desired, be unperforated, so long as a proper anode-to-cathode ratio is maintained for the particular coating involved, since the flow of electrolytic solution will be established from the side and will be continuously maintained by the combination of the angle and the movement of the strip transverse to said angle tending to move the solution to the side. This results from the induced component of motion of the electrolyte to the side as its continued movement along with the strip is blocked by the dam interposed by the wiping blade. Because of the rapid induced flow to the side, the electrolytic solution is completely changed in a very short period, maintaining fresh solution next to the strip surface and rapidly flushing away depleted solution and hydrogen bubbles diverted by the wiping blade from adjacent to the surface of the strip very rapidly. At one side of the strip is a pump 323, preferably a centrifugal pump as shown in FIG. 43, having an inlet leading to a main manifold 326 with a plurality of separate individual manifolds 335, 337 and 339 connected with one side of the spaces between the wiping blades. In addition, there is shown in FIG. 58 an improvement comprising an additional separate manifold 399 arranged in front of the series of blades 397, which separate manifold 399 also aids in drawing away electrolytic solution which is deflected to the side of the initial slanted or angled resilient wiping blades 397, thus aiding in directing said electrolytic solution to the side and out into the body of the coating bath, rather than over the tops of the perforated anodes where it might be drawn in again to the surface of the strip before being thoroughly diluted by the fresh bath solution.

The apparatus shown and described above is particularly useful and effective in the electroplating of chromium coatings on steel strip, frequently called tin free steel, or TFS, and the like, but is also very effective in other types of electroplating including tin plating, thin zinc plating and other electrolytic coatings. In other words, the use of the thin resilient wiping blade to wipe away bubbles of hydrogen, displace hydrogen from the cathodic layer upon the workpiece, remove a thin depletion layer or so-called barrier layer of at least partially depleted electrolytic solution and stabilize the strip as it passes through the electrolytic bath by guiding it with the thin flexible dielectric wiping blade which does not interfere with the electrolytic coating process, has wide application in the continuous electrolytic coating of sheet, strip and other elongated relatively flexible coated products.

As set forth above, it has been discovered that the use of the wiper blades of the invention provide very superior coatings and that their use in a process considerably increases the rate of coating by very effective removal of hydrogen bubbles which will otherwise partially occlude the surface and with some coatings, by shaving off or otherwise removing dendritic material in those cases where such material is a problem. In addition, and very importantly, in many, if not most, cases, the wiping blade also improves the coating operation by stripping away a surface layer of partially depleted electrolytic coating solution and causing new electrolytic solution to be brought down to the coating surface. In order to effectively achieve the renewal of the coating solution next to the coating piece, the wiping blade of the invention should be used in combination with a properly perforated anode through which the electrolytic coating solution can pass. The blade should also be resilient enough to exert a downward force sufficient to prevent the counter force of any thin surface or depletion layer of electrolyte carried along with the workpiece surface from lifting the blade from the coating surface, but not with sufficient downward force to mar the coated surface or interfere with the buildup of a smooth, even coating. The dielectric blade of the invention also very importantly provides a thin contact guide means between the anodes and the cathodic coating surface which effectively prevents the continuous coated material from approaching the anodes or oscillating, and prevents the cathodic work surface from arcing with the anodes which would damage both the work surface and the anodes. The resilient blades, however, are so thin and such a small cross section of them actually touches the surface that the coating action is not interfered with. The resilience or flexibility of the blade also, it has been found, prevents the blades from rapid wear of their surface.

While the present invention has been described at some length and with some particularity with respect to several described embodiments, it is not intended that it should be limited to any such particulars or embodiments or any particular embodiment, but is to be construed broadly with reference to the appended claims so as to provide the broadest possible interpretation of such claims in view of the prior art and therefore to effectively encompass the intended scope of the invention.

We claim:

1. An improved arrangement for electrolytic coating of an elongated flexible metallic substrate comprising:

(a) means to pass a longitudinally extended cathodic workpiece having at least one surface to be coated through containment means for a body of electrolytic solution containing metallic ions to be plated out upon and bathing such surface to be coated, (b) an anode mounted closely adjacent the pass line of said cathodic workpiece within said containment means in contact with said electrolytic solution, (c) at least one elongated resilient narrow surface contact dielectric means arranged generally transversely of said longitudinally extended cathodic workpiece to resiliently contact the surface to be coated of the cathodic workpiece along an extended narrow contact interface between said surface of the workpiece and the resilient narrow surface contact dielectric means while submersed in the body of electrolytic solution, (d) means to move the longitudinally extended cathodic workpiece past the resilient narrow surface contact dielectric means, and (e) means to replenish electrolytic solution within the body of solution to prevent said body of electrolytic solution from becoming depleted of coating metal ions at the electrolyte-cathode interface.

2. An improved arrangement for electrolytic coating of an elongated flexible substrate in accordance with claim 1 additionally comprising:

(f) a series of openings in the anode through which electrolytic solution may freely pass.

3. An improved arrangement for electrolytic coating of an elongated flexible substrate in accordance with claim 2 wherein the resilient narrow surface contact dielectric means comprises a strip of resilient plastic resistant to the electrolytic solution mounted with its extended narrow contact side deflected against the surface to be coated,

4. An improved arrangement for electrolytic coating of an elongated flexible substrate in accordance with claim 1 wherein the resilient narrow surface contact dielectric means comprises a strip of plastic resistant to the electrolytic solution resiliently mounted to bear directly upon the surface to be coated.

5. An improved arrangement for electrolytic coating of an elongated flexible substrate in accordance with claim 3 wherein the resilient narrow surface contact dielectric means is between one-eighth and one-thirty-second inch in thickness.

6. An improved arrangement for electrolytic coating of an elongated flexible substrate in accordance with claim 4 wherein a resilient biasing means is in contact with the narrow surface contact dielectric means to bias said dielectric means against the surface to be coated.

7. An improved arrangement for electrolytic coating of an elongated flexible substrate in accordance with claim 4 in which the resilient biasing means biases the narrow surface contact dielectric means about an angle to contact the surface to be coated.

8. An improved arrangement for electrolytic coating of an elongated flexible substrate in accordance with claim 4 wherein there are a plurality of resilient narrow surface contact dielectric means positioned at intervals along an extended anode assembly.

9. An improved arrangement for electrolytic coating of an elongated flexible substrate in accordance with claim 8 wherein the plurality of resilient narrow surface contact dielectric means are positioned on both sides of the elongated flexible substrate.

10. An improved arrangement for electrolytic coating of an elongated flexible substrate in accordance with claim 9 wherein the plurality of resilient narrow surface contact means are positioned at an acute angle with respect to travel of the strip.

11. An improved arrangement for electrolytic coating of an elongated flexible substrate in accordance with claim 10 wherein the plurality of resilient narrow surface contact means are movable longitudinally along their length to at least periodically contact fresh unworn surfaces against the surface of said elongated flexible substrate.

12. An improved arrangement for electrolytic coating of an elongated flexible substrate in accordance with claim 10 additionally comprising exhaust manifold means adjacent to the downstream ends of the angled narrow surface contact means to actively draw away electrolytic solution passing to the downstream end of the resilient narrow surface contact means.

13. An improved arrangement for electrolytic coating of an elongated flexible substrate in accordance with claim 9 wherein the plurality of resilient narrow surface contact dielectric means on both sides of the elongated flexible substrate are paired with each other on both sides.

14. An improved arrangement for electrolytic coating of an elongated flexible substrate in accordance with claim 2 wherein the openings in the anode are positioned in the anode assembly in a staggered arrangement with respect to one another to effectively equalizer the time during which any given portion of the elongated flexible substrate passes open and closed portions of the anode relative to other portions of the elongated flexible substrate.

15. An improved arrangement for electrolytic coating of an elongated flexible substrate in accordance with claim 14 wherein the openings in the anode are larger directly behind the narrow surface contact dielectric means with regard to passage of the elongated flexible substrate than in front of said narrow surface contact dielectric means.

16. An improved arrangement for electrolytic coating of an elongated flexible substrate in accordance with claim 15 wherein the resilient narrow surface contact dielectric means have a chevron configuration.

17. An improved arrangement for electrolytic coating of an elongated flexible substrate in accordance with claim 16 wherein the chevron configuration of the resilient narrow surface contact dielectric means is modified to provide a curved apex to such configuration.

18. An improved arrangement for electrolytic coating of an elongated flexible substrate in accordance with claim 16 wherein there are a series of chevron configured resilient narrow surface contact dielectric means some of which have truncated open apexes.

19. An improved arrangement for electrolytic coatings of an elongated flexible substrate in accordance with claim 18 in which a consecutive series of chevron configured extended surface contact dielectric means have a series of decreasing widths of truncated open apexes.

20. An improved arrangement for electrolytic coating of an elongated flexible substrate in accordance with claim 17 additionally comprising:

(g) pump means attached to manifold means arranged adjacent the elongated flexible substrate and perforated anodes in a position to draw electrolytic solution actively from the sides of the configuration of extended surface contact dielectric means.

21. An improved wiping means for wiping the surface of continuously extended workpieces during electrolytic coating comprising:

(a) an extended plastic blade having a narrow coating surface contact portion on one side and a mounting portion generally opposed thereto, (b) a transversely extended flange as part of the mounting portion of the blade arranged and adapted to interengage with a mounting track for such blade, (c) said blade including resilient characteristics in the narrow coating surface contact portion including a restricted contact area for contacting an electrolytic coating surface.

22. An improved wiping means in accordance with claim 21, wherein the restricted contact end is also the resilient end.

23. An improved wiping means in accordance with claim 22 wherein the plastic blade is linearly extended and arranged and constructed for progressive transverse passage across the work piece surface while supported in a mounting track.

24. An improved wiping means in accordance with claim 23 wherein the plastic blade extends across the strip from side to side at an acute angle with respect to the movement of the strip material.

25. An improved wiping means in accordance with claim 22 wherein the mounting portion of the plastic blade has a T-section configuration and the mounting track has a corresponding configuration.

26. An improved wiping means in accordance with claim 25 wherein the mounting track has at least a partially curved configuration and the narrow coating surface contact portion is periodically slit in the resilient section to allow the surface contact portion of the blade to flex.

27. An improved electrolytic coating surface wiper and anode for electrolytic coating continuous strip material comprising:

(a) an anode having a plurality of orifices through the anode through which electrolytic solution can effect substantially free passage, (b) the anode being sectionalized into separate sections with flanges at least at one end of the sections, (c) dielectric resilient wiping blade means mounted between the flanges of adjacent sections of the anode, (d) securing means to secure the flanges of adjoining sections of anode together with the wiping blade means between them into a unitary structure, (e) the dielectric resilient wiping blade means having a chevron configuration with the apex of said chevron arranged and adapted to be oriented opposite the direction of movement of continuous strip material being coated.

28. An improved electrolytic coating surface wiper and anode for electrolytic coating continuous strip material in accordance with claim 27 wherein the chevron configuration of the dielectric resilient wiping blades is modified to have a rounded apex portion facilitating passage of a continuous section of wiper blade past the such apex.

29. An improved electrolytic coating surface wiper and anode arrangement for electrolytic coating continuous strip material in accordance with claim 27 additionally comprising pump and manifold means arranged and adapted for drawing away from the sides of the continuous strip electrolytic solution from between the strip and the anodes to encourage passage of electrolytic solution into the space between the strip and the anodes through the openings extending through the anodes.

* * * * *